US007297419B2

(12) United States Patent
Watanabe

(10) Patent No.: US 7,297,419 B2
(45) Date of Patent: Nov. 20, 2007

(54) MATERIAL FOR VACUUM DEVICE, VACUUM DEVICE, VACUUM APPARATUS, MANUFACTURING METHOD OF MATERIAL FOR VACUUM DEVICE, PROCESSING METHOD OF VACUUM DEVICE, AND PROCESSING METHOD OF VACUUM APPARATUS

(75) Inventor: Fumio Watanabe, Ibaraki (JP)

(73) Assignee: Vaclab Inc. (JP)

( * ) Notice: Subject to any disclaimer, the term of this patent is extended or adjusted under 35 U.S.C. 154(b) by 376 days.

(21) Appl. No.: 10/862,358

(22) Filed: Jun. 8, 2004

(65) Prior Publication Data

US 2004/0253448 A1 Dec. 16, 2004

(30) Foreign Application Priority Data

Jun. 10, 2003 (JP) ..... 2003-165146
May 27, 2004 (JP) ..... 2004-158144
Jun. 3, 2004 (JP) ..... 2004-165775

(51) Int. Cl.
*D02G 3/00* (2006.01)

(52) U.S. Cl. ..... 428/698

(58) Field of Classification Search ..... 428/698, 428/701, 408
See application file for complete search history.

(56) References Cited

U.S. PATENT DOCUMENTS 3,833,430 A 9/1974 Hill et al.
3,969,151 A 7/1976 Hill et al.

FOREIGN PATENT DOCUMENTS

| | | |
|---|---|---|
| JP | 61-3876 | 1/1986 |
| JP | 4-285137 | 10/1992 |
| JP | 07-002277 | 6/1995 |

OTHER PUBLICATIONS

Watanabe, Fumio, J. Vac. Sci. Technol. A 19(2), Mar./Apr. 2001, pp. 640-645.

*Primary Examiner*—Jennifer McNeil
*Assistant Examiner*—Daniel Miller
(74) *Attorney, Agent, or Firm*—Bacon & Thomas, PLLC

(57) ABSTRACT

The present invention relates to a manufacturing method of a material for vacuum device used in a vacuum apparatus that generates ultra-high vacuum and performs processing. Its constitution has the steps of: reducing pressure around the alloy of Cu and a doping element; increasing the temperature of the alloy to outgas hydrogen from the alloy, and gathering the doping element near the surface of the alloy and precipitating the doping element; and exposing the alloy to single oxygen, single nitrogen, mixed gas of oxygen and nitrogen, ozone ($O_3$), oxygen content compound, nitrogen content compound or oxygen-nitrogen content compound, or a combination of them, or a plasma thereof while the temperature of the alloy is maintained at a range of room temperature or higher and the temperature of the alloy increased for outgassing hydrogen or lower, whereby it is reacted with the precipitated doping element so that one of an oxide film, a nitride film and an oxide-nitride film of the doping element is formed on a surface layer of the alloy.

7 Claims, 13 Drawing Sheets

(A) After Electropolishing (B) 300°C × 24h (C) 400°C × 24h
(D) 400°C × 72h (E) 500°C × 24h (A) After Electropolishing (B) 300°C × 24h (C) 400°C × 24h
(D) 400°C × 72h (E) 500°C × 24h (A) After Electropolishing (B) 300°C × 24h (C) 400°C × 24h
(D) 400°C × 72h (E) 500°C × 24h

MATERIAL FOR VACUUM DEVICE, VACUUM DEVICE, VACUUM APPARATUS, MANUFACTURING METHOD OF MATERIAL FOR VACUUM DEVICE, PROCESSING METHOD OF VACUUM DEVICE, AND PROCESSING METHOD OF VACUUM APPARATUS

BACKGROUND OF THE INVENTION

1. Field of the Invention

The present invention relates to materials for vacuum devices, vacuum devices used for a vacuum apparatus that generates ultra-high vacuum, a vacuum apparatus, a method of manufacturing materials for vacuum, a method of manufacturing vacuum devices, and a method of manufacturing vacuum apparatus.

2. Description of the Prior Art

The need for a vacuum apparatus which performs an operation in a pressure-reduced atmosphere (may be described as 'in vacuum' hereinafter), such as manufacturing apparatus for producing semiconductor devices, an analyzer of materials or the like and a large particle accelerator, are increasingly on the rise. In the vacuum apparatus, vacuum materials have been improved constantly since the degree of vacuum directly relates to the quality of operation.

The following patent document 1 describes a surface treatment of pure copper or various Cu alloys used for the vacuum device, which was created by the same inventor as the inventor of this application. The document describes that the surface treatment is completed in such a manner that surface cleaning by electro-polishing and baking in a vacuum after evacuation for the reduction of an oxide film layer are sequentially performed to make the inner surface of a chamber become a pure metal state. This has enabled the vacuum apparatus such as a sputtering apparatus and a vacuum thermal treatment apparatus to obtain an outgassing rate of approximately $10^{-11}$ Pa·m/s (hereinafter, referred to as Pa $(H_2)$·m/s) as a pressure calculated in a hydrogen equivalent (which is taken one order of magnitude lower in a nitrogen equivalent pressure).

[Patent Document 1]

Japanese Patent Laid-open No.07-002277 publication

Meanwhile, the outgassing rate lower than $10^{-12}$ Pa $(H_2)$·m/s has been required in the vacuum apparatus for generating further ultra-high vacuum, and further improvement of the vacuum materials is desired.

SUMMARY OF THE INVENTION

It is an object of the present invention to provide the materials for vacuum device, the vacuum devices used for the vacuum apparatus, the vacuum apparatus, the manufacturing method of materials for vacuum device, the processing method of vacuum device, and the processing method of vacuum apparatus, which are capable of achieving the outgassing rate from the vacuum device lower than $10^{-12}$ Pa $(H_2)$·m/s.

In the vacuum materials of the present invention, an oxide film, a nitride film or an oxide-nitride film of a doping element is coated on the surface of a base material made of an alloy of Cu and at least one of Be, B, Mg, Al, Si, Ti and V which are the doping elements.

The materials for vacuum device can be fabricated as follows. Specifically, the temperature of alloy of Cu and the doping element is increased to remove hydrogen from the alloy, and the doping element in the alloy is gathered near the surface and precipitated. Then, while the temperature of the alloy is maintained at a range of room temperature or higher and the temperature of the alloy increased for removing hydrogen or lower, the alloy is exposed to processing agent such as single oxygen, single nitrogen, mixed gas of oxygen and nitrogen, ozone $(O_3)$, oxygen content compound, nitrogen content compound and oxygen-nitrogen content compound, or processing agent made by a combination of them, or processing agent made by a plasma thereof and thus the oxide film, the nitride film or the oxide-nitride film of the doping element is formed.

When a metal bulk is used as the material for vacuum device, the following is essential in order to obtain the outgassing rate of $10^{-12}$ Pa$(H_2)$·M/s (in a hydrogen equivalent pressure) or less. Specifically, it is to remove hydrogen in the metal bulk and to form a barrier film capable of preventing incoming/outgoing of hydrogen into/from the metal bulk on a metal bulk surface because the metal bulk contains hydrogen more or less.

Cu itself is a material for which it is difficult to solve hydrogen and thus has preferable property as the material for vacuum device. On the other hand, Cu is too soft to be used as the material for vacuum device used for a chamber or the like of vacuum apparatus. In this case, if the alloy of Cu and the doping element, specifically, such as Be, B, Mg, Al, Si, Ti and V, is used, then the strength and the hardness of the material can be increased. Therefore, the alloy of Cu and the above-described doping element is preferable as the material for vacuum device.

Further, a copper oxide film is easily formed on a surface when the Cu alloy contacts air or the like. The copper oxide film has property such that hydrogen is prevented from permeating the film, although the preventing effect is not perfect. Accordingly, when the copper alloy coated with the copper oxide film is used as the vacuum device without removing hydrogen from the Cu alloy, the degree of vacuum does not rise readily because hydrogen is gradually outgassed from the Cu alloy bulk through the copper oxide film.

In the present invention, by heating the Cu alloy bulk to increase its temperature in the vacuum, hydrogen in the alloy bulk gathers to the surface and outgasses from the alloy surface. Even if the copper oxide film is formed on the surface, the hydrogen reduces and decomposes the copper oxide film formed on the surface. This allows hydrogen to be outgassed from the alloy bulk to the outside without encountering any obstacle. Note that, when stainless steel is used as the material for vacuum device, a chromium oxide film (mixed crystal with iron oxide is also possible), which prevents hydrogen from permeating the film, is generated on the surface by contacting air. The film is not reduced readily by hydrogen even if thermal treatment is performed. For this reason, if the chromium oxide film is formed before hydrogen outgassing processing, the removal of hydrogen inside stainless steel is difficult unlike the present invention even if thermal treatment is performed. Further, when the vacuum devices are fabricated by stainless steel, the degree of vacuum does not rise as well because internal hydrogen gradually comes out through the chromium oxide film.

On the other hand, the doping element in the Cu alloy, which is particularly Be, B, Mg, Al, Si, Ti or V having a smaller atomic number than Cu, is smaller in atomic radius and lighter. Thus when the temperature of the Cu alloy is increased in the vacuum, it easily gathers to the surface of the alloy due to diffusion, and precipitates on the alloy surface. Therefore, while the temperature of the alloy is maintained at a range of room temperature or higher and the temperature of the alloy increased for removing hydrogen or lower, the doping element precipitated on the alloy surface is oxidized or nitrided by exposing the alloy to a processing agent containing at least one of oxygen and nitrogen or a plasma thereof to form the oxide film, nitride film or oxide-nitride mixed film of the doping element. The oxide film or the like of the doping element that is Be, B, Mg, Al, Si, Ti and V in particular, which is formed in this manner, has a superior barrier function against hydrogen. Note that Cr does not gather readily to the alloy surface in a Cu alloy containing Cr as the doping element, so that it is difficult to form a dense chromium oxide film or the like on the alloy surface even if the same treatment as that of the present invention is performed. Consequently, the chromium oxide film or the like on the surface of the Cu alloy containing Cr as the doping element, which is formed in the same processing as the present invention, is not sufficient as a barrier layer against hydrogen.

The material for vacuum devices of the present invention has a small internal hydrogen content and does not outgas hydrogen from inside its mass. Furthermore, the oxide film of the doping element also can prevent hydrogen generated by the dissociation/adsorption of water or hydrogen from air or the like from newly permeating into the material. Therefore, in a vacuum apparatus using the alloy, even when pressure reduction and restoration to atmospheric pressure are performed alternately, by performing only in-situ thermal treatment to remove moisture or the like which is adhered to the barrier layer surface by physical adsorption before vacuum treatment, the outgassing of hydrogen from the vacuum devices can be suppressed to reduce the outgassing rate to $10^{-12}$ Pa ($H_2$) Em/s or less, and thus ultra-high vacuum can be easily obtained.

Further, the above-described material for vacuum device may be machined to fabricate vacuum devices, and the vacuum apparatus may be fabricated using the vacuum devices. Consequently, in the vacuum apparatus equipped with such vacuum devices, hydrogen outgassing into the vacuum is prevented to drastically reduce outgassing rate from the vacuum devices and thus ultra-high vacuum can be easily obtained.

Alternatively, before performing the processing of hydrogen outgassing and barrier layer formation to the alloy material of Cu and the doping element according to the present invention, the alloy material is machined to fabricate the vacuum devices, or the vacuum devices are further assembled to fabricate a vacuum apparatus, and then, the processing of hydrogen outgassing and barrier layer formation of the present invention may be performed to the vacuum devices and the vacuum devices of the vacuum apparatus. Thus, hydrogen in the vacuum devices is reduced and the barrier layer against hydrogen can be formed on the surface of the vacuum devices. Furthermore, in the vacuum apparatus where the, processing of the present invention is applied to the vacuum devices, hydrogen outgassing from the vacuum devices into the vacuum can be prevented to reduce the outgassing rate drastically, and thus ultra-high vacuum can be easily obtained.

DESCRIPTION OF THE PREFERRED EMBODIMENT

Embodiments of the present invention will be explained with reference to the drawings hereinafter.

First Embodiment (i) Examination and its Result

The examination and its result, which has led to the creation of this invention will be explained as follows.

(Surface Changes of Copper Alloy Due to Vacuum Thermal Treatment)

(a) Fabrication of Samples 0.2% beryllium content copper alloy (0.2% BeCu alloy) (contains 2% Ni) and 2% beryllium content copper alloy (2% BeCu alloy) (contains 2% Ni) were used as the alloy material of examination samples. Further, 0.6% chromium content copper alloy (0.6% CrCu alloy) and 1.6% chromium content copper alloy (1.6% CrCu alloy) were used as comparative examination samples. Four pieces of the alloy materials machined into a cylindrical shape having a diameter of 5 mm and a height of 5 mm were prepared and they were used as the examination samples.

The four examination samples were thermally treated under the following conditions in the vacuum having the level of vacuum at $10^{-6}$ Pa.

(α) 300° C. 24 hours (β) 400° C. 24 hours (γ) 400° C. 72 hours (δ) 500° C. 24 hours After the thermal treatment, the temperature was lowered to room temperature and the examination samples were exposed to oxygen, and then they were brought out to air. Then, the samples were left to stand in air as they were for about one month.

(b) Examination Method and its Result

An XPS (X-ray Photoelectron Spectroscopy) surface analyzer was used to examine the elements distribution in a surface atomic layer before thermal treatment and after the above-described thermal treatment regarding all the samples.

Figure 1A:
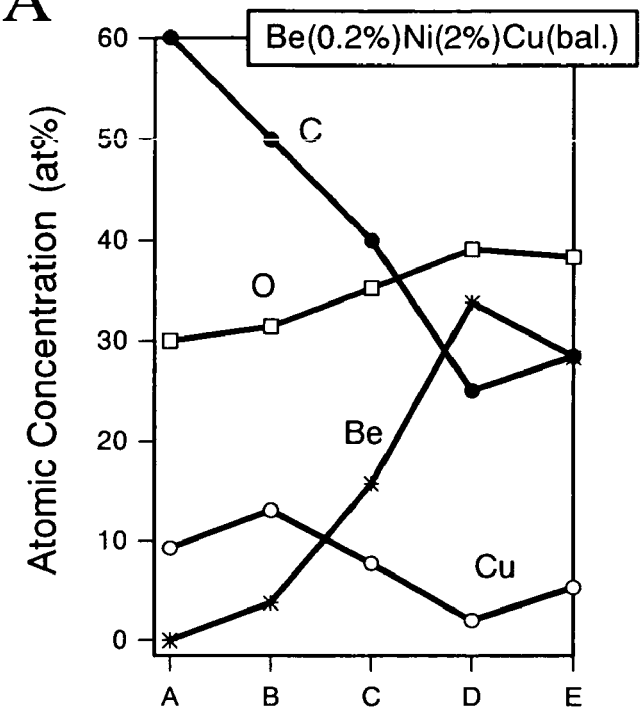
FIGS. 1A and 1B are graphs showing a distribution state of atoms on an alloy material surface according to the difference of thermal treatment conditions to alloy materials for vacuum device, which is a first embodiment of the present invention.
Figure 1B:
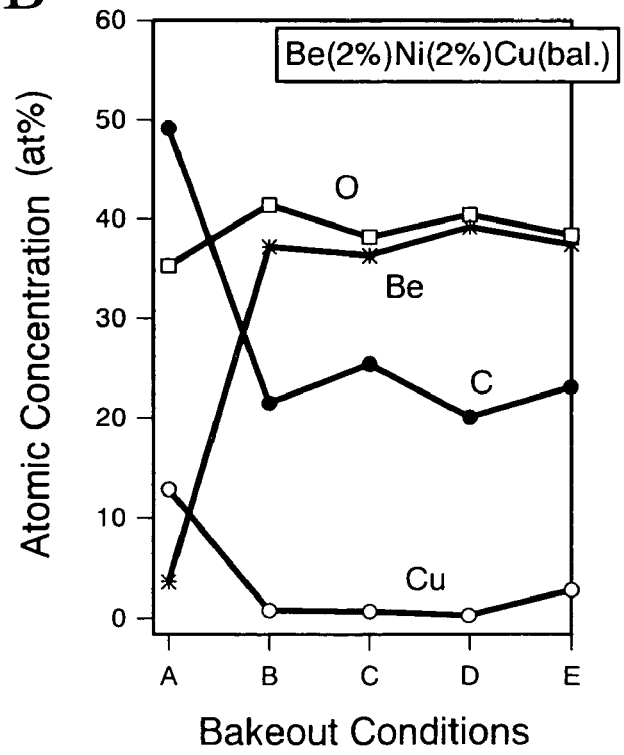
Figure 2A:
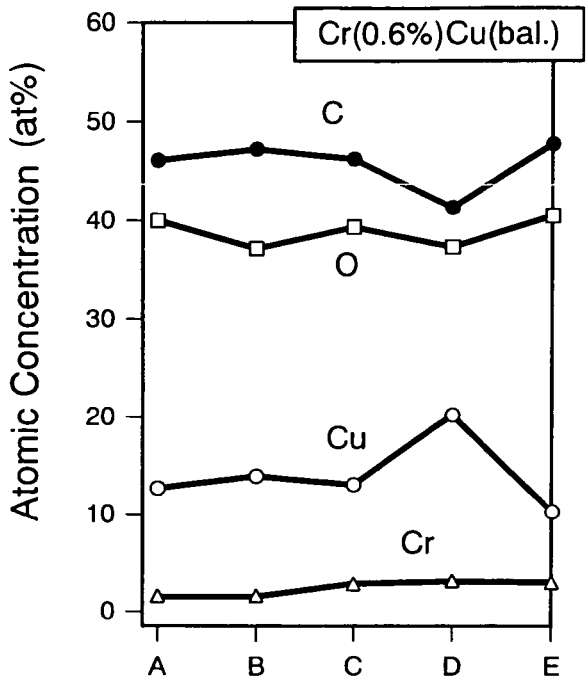
FIGS. 2A and 2B are graphs showing the distribution state of atoms on an alloy material surface according to the difference of thermal treatment conditions to alloy materials for vacuum device, which is a comparative example.
Figure 2B:
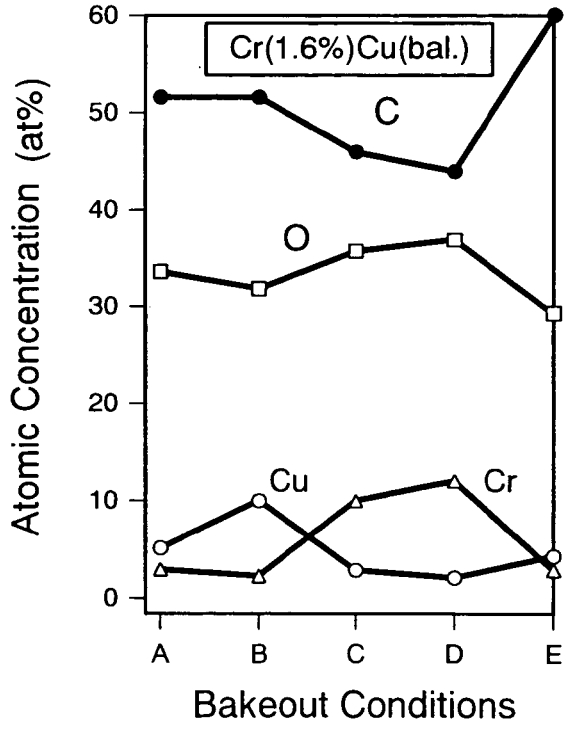

FIGS. 1A and 1B show the result. In FIGS. 1A and 1B, the axis of ordinate shows the concentration (at %) of various atoms measured, which are expressed in linear scale, and the axis of abscissa shows the respective thermal treatment conditions of (A) to (E). The thermal treatment conditions of (A) to (E) are described below the graphs. Note that the same examination was conducted for the chromium content copper alloy, and FIGS. 2A and 2B show the result. The expression of the axis of ordinate and the axis of abscissa are the same as those of FIGS. 1A and 1B.

Figure 3A:
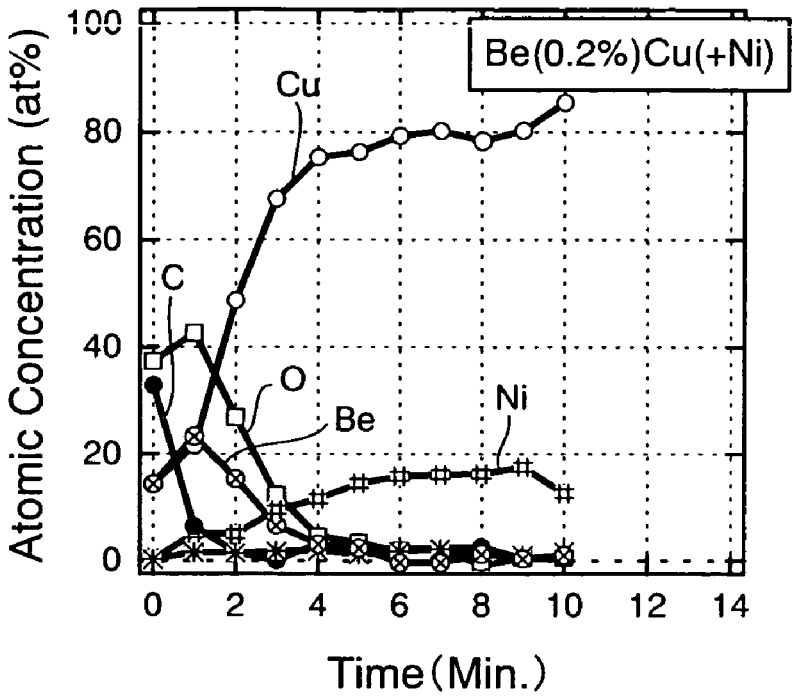
FIGS. 3A and 3B are graphs showing result where an in-plane distribution ratio of the atoms of the alloy material for vacuum device, which is the first embodiment of the present invention, was measured sequentially in a depth direction.
Figure 3B:
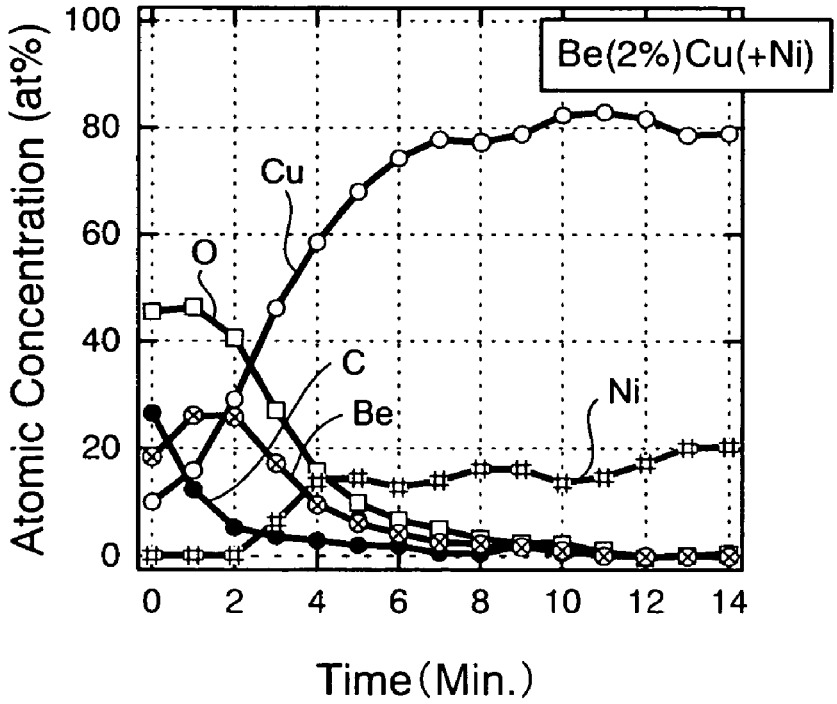
Figure 4A:
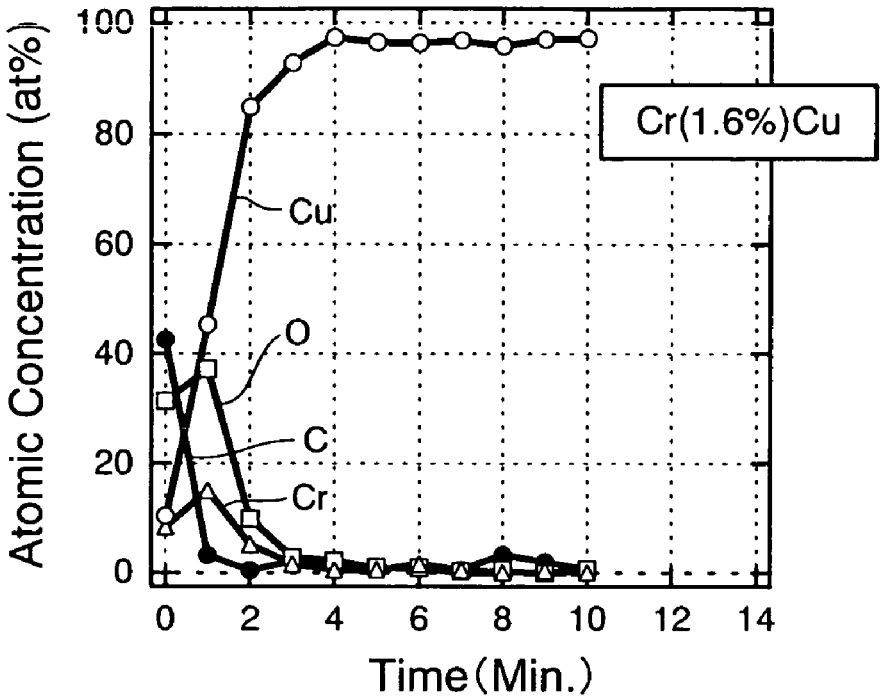
FIGS. 4A and 4B are graphs showing result where the in-plane distribution ratio of the atoms of the alloy material for vacuum device, which is a comparative example, was measured sequentially in a depth direction.
Figure 4B:
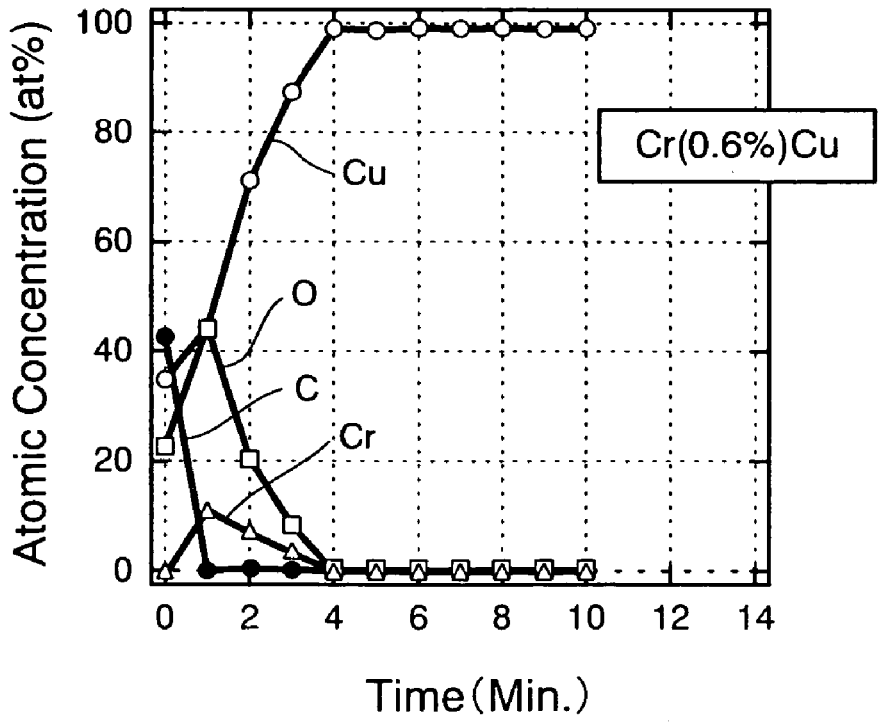

Further, FIGS. 3A and 3B show the result where the in-plane distribution ratio of the atoms were measured sequentially in the depth direction with regard to the beryllium content copper alloy to which the thermal treatment of 400° C. for 72 hours was performed. A measurement surface in the depth direction was sequentially exposed by argon etching. In FIGS. 3A and 3B, the axis of ordinate shows the concentration (at %) of various atoms measured, which is expressed in linear scale, and the axis of abscissa shows time (minutes) of argon etching, which is expressed in linear scale. Note that the same examination was conducted for the chromium content copper alloy, and FIGS. 4A and 4B show the result. The expression of the axis of ordinate and the axis of abscissa are the same as those of FIGS. 3A and 3B.

The following (α) to (δ) were derived from the results of FIGS. 1A, 1B and FIGS. 3A, 3B.

(α) In the pre-bakeout conditions, as the temperature increases from 300° C. to 400° C. and as pre-bakeout time increases from 24 hours to 72 hours, diffusion amount of Be metal atoms from bulk to the surface increases.

(β) As the ratio of Be on the surface of the alloy material increases, the ratio of carbon contamination on the surface of the alloy material reduces. In the thermal treatment of 400° C. for 72 hours, the ratio of BeO becomes a maximum and the carbon content as surface contamination reduces.

(γ) The above effect is more conspicuous in 1.9% to 2% beryllium content copper alloy, where the amount of diffused Be reaches saturation even under the lowest-temperature thermal treatment of 300° C. for 24 hours. Moreover, the ratio dominated by Be atoms on the surface does not increase even in the high-temperature and long-time thermal treatment. Accordingly, it suggests that approximately 38% of Be is in the surface state covered with BeO by 100%.

(δ) It turns out that a beryllium oxide layer is formed to the depth of 10 nm to 15 nm (4.5 nm/min.) in the depth direction. In 2% beryllium content copper alloy (FIG. 3B), it turns out that a beryllium oxide layer is formed to the depth of 15 nm to 20 nm. In a case that this thermal treatment is not conducted (in a case of only machining), a thickness of the oxide film of the doping metal is only about several nm to 5 nm. On the other hand, the same effect as that of 2% beryllium content copper alloy is obtained even in 0.2% beryllium content copper alloy of a small beryllium content when the thermal treatment of 400° C. for 72 hours is applied to it. Since the ratio of Be reaches 34%, it is presumed that approximately 90% of the surface has become a BeO film.

Contrarily, following (α) to (δ) were derived from the results of FIGS. 2A, 2B and FIGS. 4A, 4B regarding the chromium copper alloy.

(α) Approximately 50% of a surface layer is contaminated by carbon (or CO), and the ratio of surface atoms changes little before and after the thermal treatment.

(β) At second oxygen atoms are present and at third Cu atoms are present as an oxide layer that consists of CuO or $Cu_2O$, and the ratio dominated by a $Cr_2O_3$ film is small. It is hard to conclude that a dense $Cr_2O_3$ film is formed.

(γ) In the 1.6% chromium content copper alloy, the ratio dominated by the $Cr_2O_3$ film becomes larger than that of CuO after 400° C. bakeout, but the contamination ratio of C is larger than in 0.6% alloy.

As a result, the following sample out of the four kinds of copper alloy, to which examination was conducted as a structure material for ultra-high vacuum, is optimum as the material for vacuum device. The sample is the 0.2% beryllium content copper alloy to which the thermal treatment of 400° C. for 72 hours was applied in the vacuum, followed by lowering the temperature and then exposing the alloy to oxygen. Further, the alloy is preferable from the points that it has high electric conductivity, is relatively inexpensive, has small amount of toxic beryllium and a small surface contamination.

(Temperature Desorption Spectroscopy (TDS))

(a) Fabrication of an Examination Sample

Figure 5:
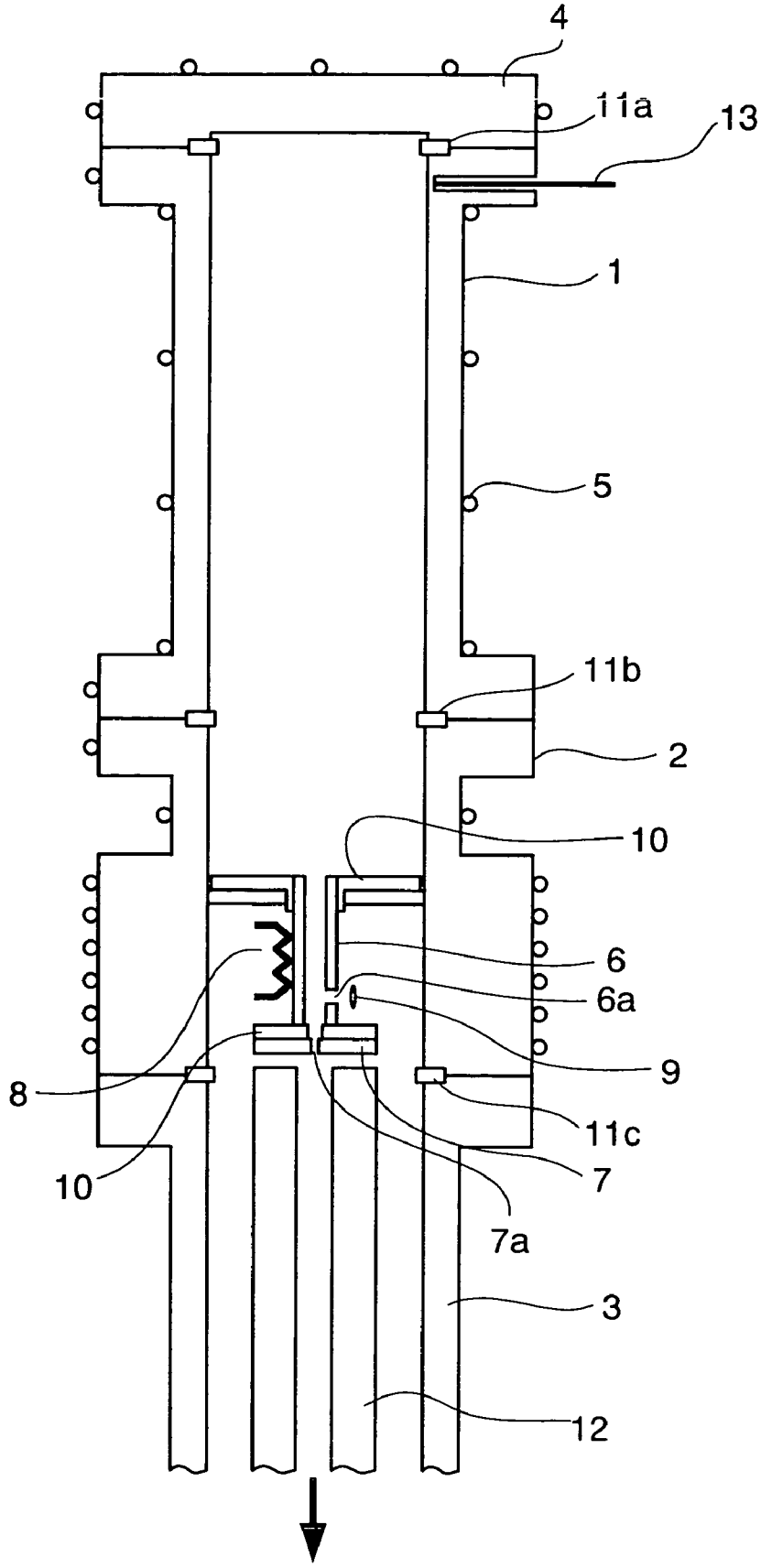
FIG. 5 is a side view showing a system analyzing with temperature desorption spectroscopy gas regarding a chamber sample manufactured by using the alloy material for vacuum device, which is the first embodiment of the present invention.

FIG. 5 shows a chamber sample which is composed of a combination of a flange having a diameter of 70 mm integral with a cylinder 1 having the diameter of 46 mm and a lid 4 that closes one open end of the cylinder 1 to isolate the interior of the cylinder 1 from outside air, and a quadruple residual gas analyzer (RGA) constituted of an ionizer section 2 and a lower section 3. The cylinder 1 was fabricated by machining a raw material of commercially available 0.2% beryllium content copper alloy.

After the machining of mechanical cutting to the alloy material, anode electro-polishing was applied to the vacuum devices in 50% phosphoric acid diluted solution and rinsed by distilled water. Then, the quadruple residual gas analyzer was attached to the chamber sample by sandwiching silver-plated copper gaskets 11*a*, 11*b*, 11*c* between them. Furthermore, sheath heater 5 was wound around the outer wall of the chamber sample and the quadruple residual gas analyzer. The temperature of the chamber sample is measured by a thermocouple 13.

Next, the ionizer flange 2 and the lower-part flange 3 will be explained in detail.

The ionizer flange 2 is provided with an ionizer anode electrode 6 of a mass analyzer, which has a slit 6*a*, an electrode 7 having an aperture 7*a*, an anode heater 8 for eliminating gas which is adsorbed to the anode 6 other than the atmosphere, a filament (cathode) 9 that is an electron irradiation source for ionization, and quartz 10 for insulation. The anode heater 8 is turned off during gas analysis.

Further, the lower-part flange 3 is provided with four Q poles 12. Although the drawing shows only two Q poles, total four Q poles are actually provided such that they oppose to each other two by two. The opposing Q poles 12 are connected with wire and when high-frequency voltage to which direct-current and alternate-current are superposed is applied between the two pairs, only ions of mass resonant with the voltage ratio pass between the Q poles 12. Specifically, it is the mass analyzer referred to as a mass filter. It is often referred to as the residual gas analyzer (RGA) when conducting vacuum atmosphere gas analysis.

When the cathode 9 is heated to emit electrons and then electrons are implanted toward the inside of the anode 6 through the slit 6*a* of the anode 6, ions of atmosphere gas existing inside the anode 6 are generated. The gas ions are sent to the Q poles 12 through the aperture 7*a* of the electrode 7 and then mass analysis is performed.

(b) Examination Method and its Result

The examination with temperature desorption spectroscopy was performed in such a manner that temperature was increased by the sheath heater 5 at the rate of about 0.5° C./second and outgassing characteristic with the temperature increase was examined. In this case, the following two kinds of treatment was applied to the chamber sample for comparison, and the examination of spectrum analysis with temperature desorption spectroscopy was performed before and after the treatment.

Figure 6A:
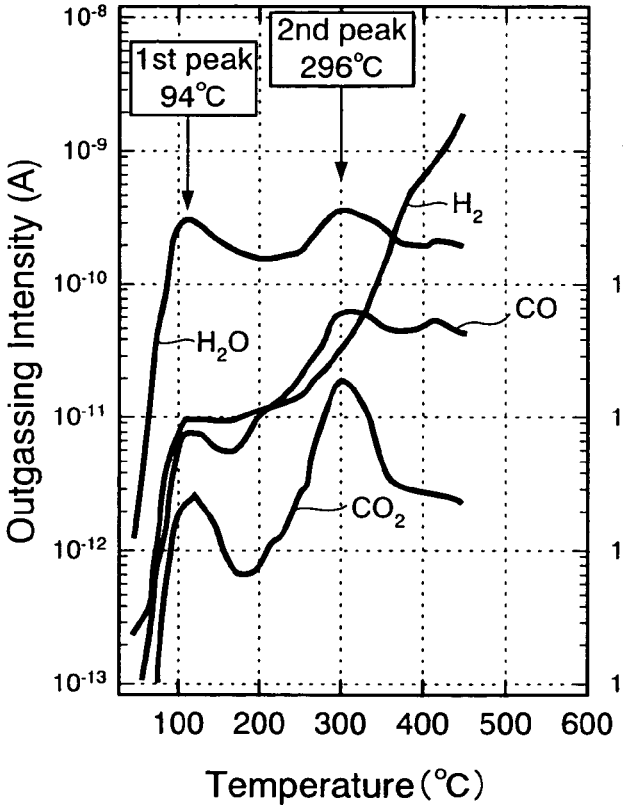
FIG. 6A is a graph showing an analyzing result of a chamber sample (sample A) in FIG. 5 before thermal treatment with the temperature desorption spectroscopy.
Figure 6B:
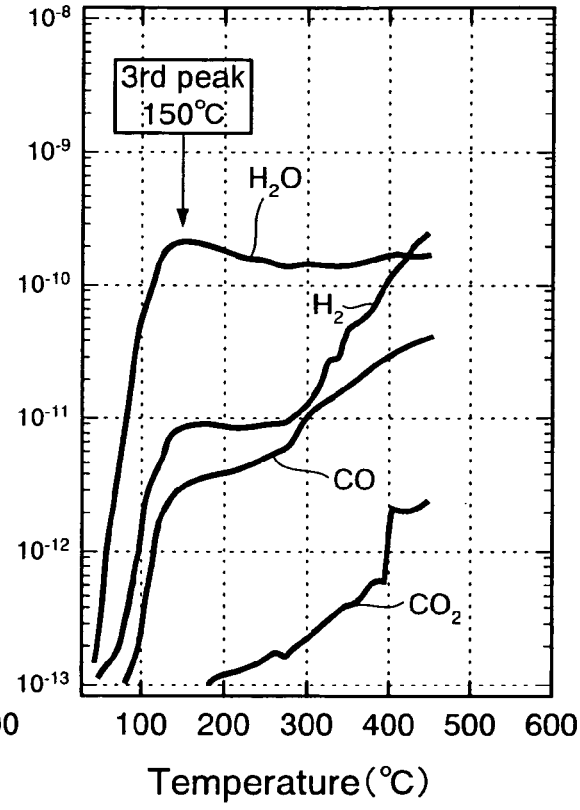
FIG. 6B is a graph showing an analyzing result of a chamber sample (sample B) after 72-hour thermal treatment at 400° C. in a vacuum with the temperature desorption spectroscopy.

FIGS. 6A and 6B show the examination result. FIG. 6A shows the examination result of spectrum analysis of the chamber sample (sample A) before treatment. FIG. 6B shows the examination result of spectrum analysis of the chamber sample (sample B) with temperature desorption spectroscopy after 72-hour thermal treatment at 400° C. in a vacuum. In each drawing, the axis of ordinate shows an outgassing intensity (A) expressed in logarithmic scale and the axis of abscissa shows measuring temperature (° C.) expressed in linear scale. The outgassing intensity (A) is an output current from RGA. The measuring temperature was set to the range from 25° C. to 450° C. or more.

(α) Sample A

From the ratio of 0.2% Be, 2% Ni and bal. Cu in the 0.2% beryllium content copper alloy, it is considered that 97% or more of the surface atoms after electro-polishing has become copper oxide mixed crystal ($CuCO_3$ $Cu(OH)_2$) $_nH_2O$). Therefore, it is presumed as shown in FIG. 6A that the first peak which appears at the measuring temperature of approximately 94° C. in the spectrum of moisture ($H_2O$) indicates moisture generated by thermal decomposition (desorption) of the mixed crystal. It is presumed that the second peak which appears at 290° C. indicates moisture which is generated with the deoxidization of a copper oxide film by reducing reaction caused by hydrogen atoms which are diffused from the inside of copper bulk. The sudden increase of hydrogen along the second peak is considered to indicate the above reaction and the increase of hydrogen diffused outwards from the inside.

Consequently, application of the thermal treatment at 300° C. or more, preferably near 400° C. in the vacuum allows hydrogen inside copper to be diffused and outgassed from the surface.

(β) Sample B

The chamber sample in the state of sample A was temporarily removed from the ionizer flange of the residual gas analyzer, and then a surface oxide layer of a chamber sample inner wall was removed by electro-polishing, so that the surface was returned to a substantially initial state (surface whose 97% or more is copper). From this state, the chamber sample was moved to another vacuum thermal treatment chamber to conduct thermal treatment of 400° C. for 72 hours. Next, the temperature of the sample was lowered to 40° C. and then the sample was exposed to oxygen gas. Thus, the BeO film is formed on the surface of the chamber sample again (refer to data D of FIG. 1A). Then, the ionizer flange of the residual gas analyzer was attached to the chamber sample. The spectrum analysis examination with the temperature desorption spectroscopy was performed using this as sample B.

As shown in FIG. 6B, a single peak (third peak) appeared in the moisture spectrum and its intensity became smaller. This shows that the surface layer is a single compound structure of BeO, and a structure change due to the reducing reaction of the surface layer did not occur by temperature-rise.

Moreover, with regard to samples A and B, if outgassing intensity of hydrogen ($H_2$) at 450° C. of maximum elevating temperature is compared with each other, that of the sample B is approximately 1/10 lower than that of the sample A. This clearly indicates the effect by the thermal treatment (400° C., 72 H) for hydrogen removal which was conducted in a vacuum during fabricating the sample B.

(Outgassing Rate Examination by Gas Accumulation Method)

(a) Fabrication of Examination Sample

Figure 7:
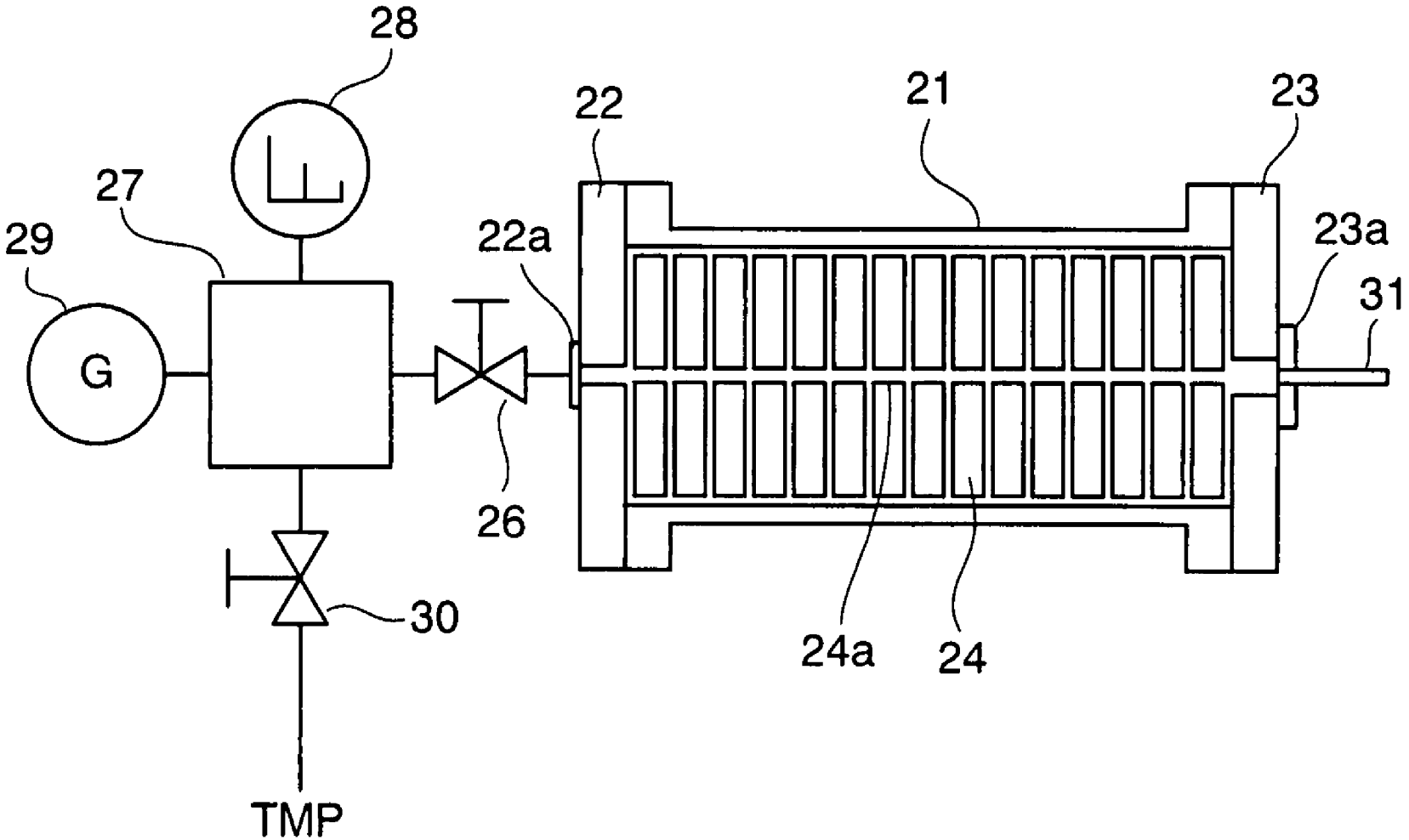
FIG. 7 is a side view showing an outgassing rate measurement experiment system by a pressure-rise method, which was fabricated by using the material for vacuum device, which is the first embodiment of the present invention.

FIG. 7 shows the outgassing rate measurement experiment system by a pressure-rise method used in this examination.

The fabricating method is as follows. Firstly, preparation is performed for 2 pieces of conversion flanges 22, 23 having the diameter of 152 mm, a nipple chamber 21 having the outer diameter of 152 mm (inner diameter: 100 mm) and the length of 300 mm and 15 pieces of disks 24 having the diameter of 99 mm and the thickness of 20 nm. Each of the 2 pieces of conversion flanges 22, 23 is made of 0.2% beryllium content copper alloy and has a gas communication hole formed at the center thereof. Each of the 15 pieces of disks 24 is made of 0.2% beryllium content copper alloy and has a hole 24*a* of 5 mm at the center thereof.

Next, thermal treatment of 400° C. for 72 hours was applied to all the vacuum devices in a vacuum thermal treatment furnace. Then, the temperature was lowered to room temperature, followed by exposing each of the vacuum devices to pure oxygen. After that, the devices are left to stand in air for about a week. Then, 15 pieces of the disks 24 are inserted in the nipple chamber 21, followed by attaching the conversion flanges 22, 23 between which a silver-coated copper gasket is sandwiched. V/A at this point was set to $2\times10^{-5}$ m. Here, V and A show the total volume of gap in the nipple chamber 21, and the total inner surface area of a vacuum side in the disks 24, the nipple chamber 21 and the conversion flanges 22, 23. Further, a spinning rotor gauge (SRG) 31 and mini sealing valve 26, both of which are made of stainless steel, are attached to the conversion flanges 22, 23 through the flanges 22*a*, 23*a* while a silver-coated copper gasket is sandwiched therebetween. A pre-bake thermal treatment of 350° C. for 24 hours was applied previously to SRG 31 and mini sealing valve 26. The mini sealing valve 26 is provided between the flange 22*a* and the joint 27, and it is opened at the time of evacuation of the inside of the nipple chamber 21, while it is closed at the time of accumulation of gas in the nipple chamber 21.

Then, a residual gas analyzer 28, a gauge 29 for measuring the degree of vacuum, a nipple chamber 21 and a turbomolecular pump (TMP) are parallelly connected each other to a joint 27. The residual gas analyzer 28 analyzes gas inside the nipple chamber 21. TMP evacuates the nipple chamber 21 or the like via the joint 27.

In FIG. 7, reference numeral 30 denotes a main valve (MV) provided between the joint 27 and TMP.

Note that a system identical to the above-described system was fabricated by stainless steel 304 for comparison.

(b) Examination Method and the Result

Outgassing rate Q(t)(Pa·m/s) is derived by using the following equation.

$$Q(t)=V/A\cdot\Delta P(t)/\Delta t$$

where $\Delta P(t)/\Delta t$ show the pressure changes in the nipple chamber 21 per unit time. The pressure P (Pa) was measured by SRG 31. Note that the outgassing rate Q(t) includes outgassing from the inner surface of the mini sealing valve 26 and SRG 31 (its area is equivalent to 0.7% of the total inner surface area), which are made of stainless steel.

Next, the changes of the outgassing rate over a long period of accumulation time will be explained.

Figure 8A:
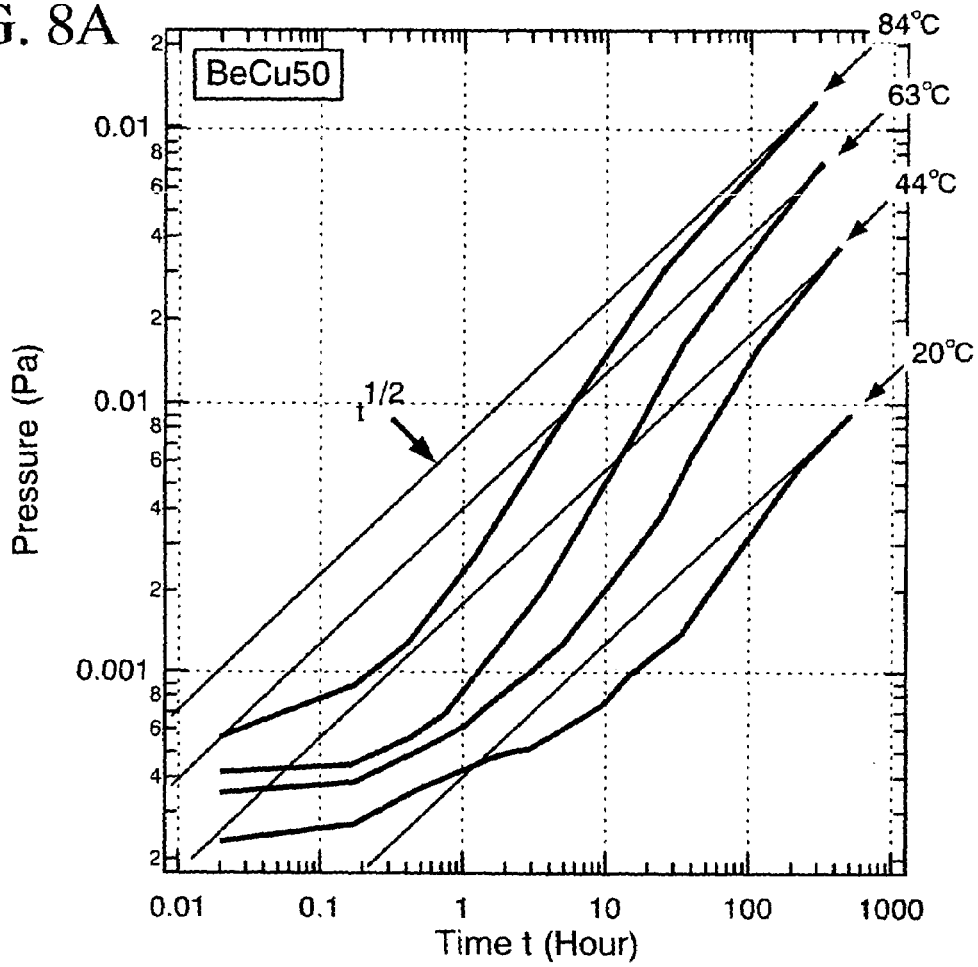
FIG. 8A is a graph showing the changes of pressure-rise with respect to accumulation time regarding the material for vacuum device, which is the first embodiment of the present invention.
Figure 8B:
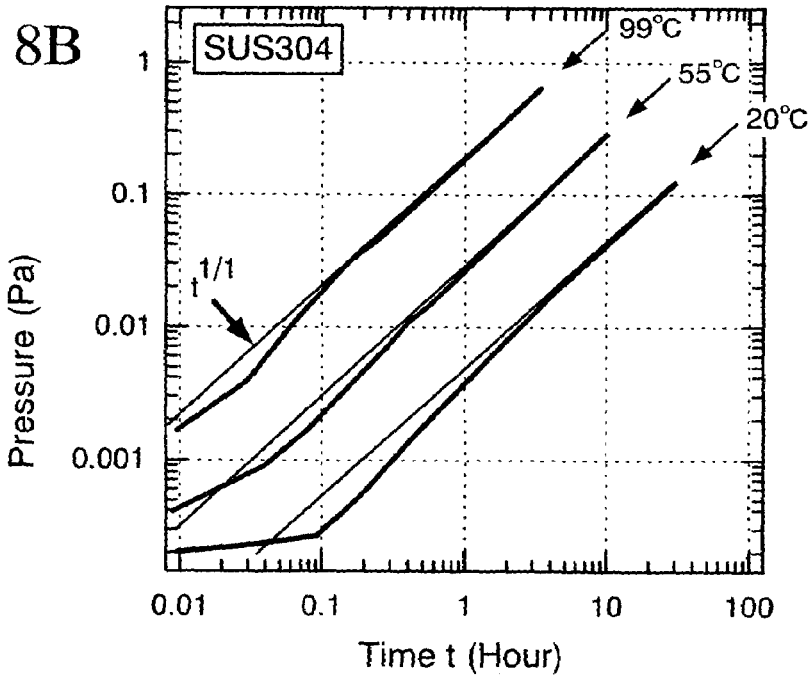
FIG. 8B is a graph showing comparative data where the same examination was performed to the alloy material for vacuum device, which is the comparative example.

FIG. 8A is the graph showing the changes of pressure-rise with respect to accumulation time regarding 0.2% beryllium content copper alloy. FIG. 8B is the graph showing the comparative data of the same examination performed to stainless steel (SUS304). In both cases, the axis of ordinate and the axis of abscissa show the pressure $P(Pa(H_2))$ expressed in logarithmic scale and the accumulation time t(h) expressed in logarithmic scale, respectively. Before measurement, the in-situ bakeout for the sample is applied at 200° C. for 24 hours. After cooling down, regarding the measurement sample temperature, 20° C., 44° C., 63° C. and 84° C. were used for the case of 0.2% beryllium content copper alloy and 20° C., 55° C. and 99° C. were used for the case of stainless steel.

Before measuring the outgassing rate, the pressure is made to be an equilibrium condition with an evacuation system at the above temperature, the gas communication path connecting to the evacuation system was closed to seal the inside of the nipple chamber 21 while maintaining the sample temperature at a constant level. Then, the pressure P was measured sequentially over time lapse as follows.

As shown in FIG. 8A, the pressure-rise curve with respect to the accumulation time is completely non-linear, and 4 to 5 days were needed until the curve became a straight line in the case of the sample temperature of 84° C. Subsequently, an accumulation was performed for about 3 weeks, and it was confirmed that the curve became a complete straight line. Still further, the gas communication path was opened to evacuate the gas accumulated inside, and analysis of the gas accumulated in the nipple chamber 21 was performed using the residual gas analyzer 28. Consequently, it was confirmed that 99.99% or more was hydrogen.

Next, sample temperature was lowered to 63° C. while the gas communication path was kept open, and evacuation in a stable condition was performed for 24 hours. Then, the gas communication path was closed again to perform accumulation at 63° C. And then, the outgassing rate was measured in the same manner as described above. The outgassing rates at the sample temperatures of 44° and 20° were measured repeatedly with this method.

Figure 9A:
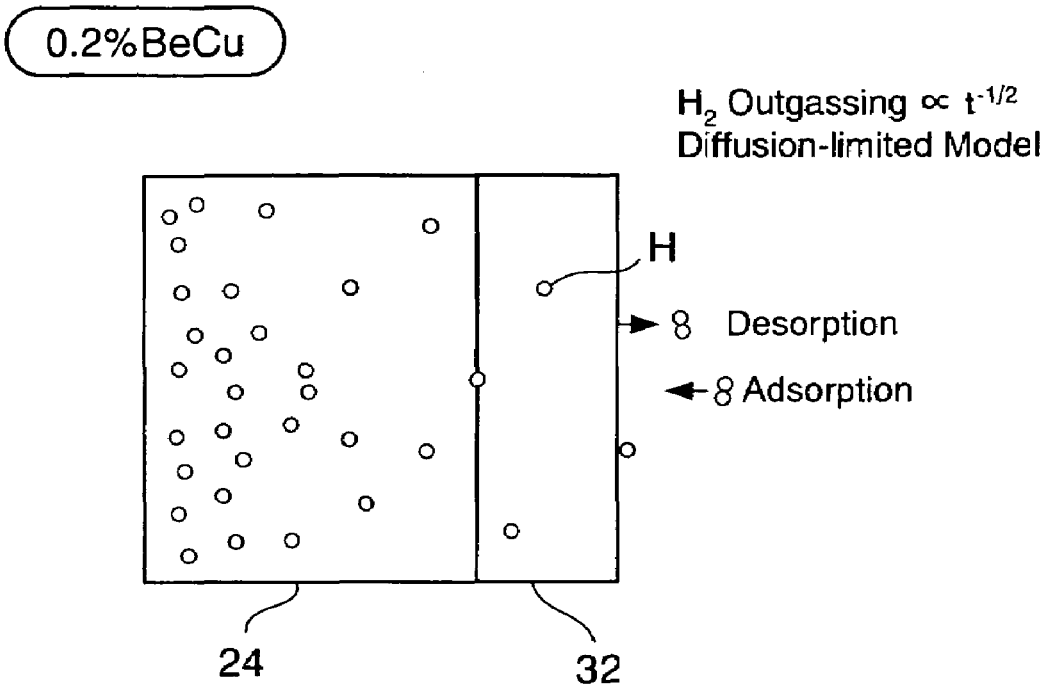
FIG. 9A is a schematic view showing outgassing of hydrogen from the material for vacuum device, which is the first embodiment of the present invention.

According to FIG. 8A, the P(t) curve, that is, $\Delta P/\Delta t$ of 0.2% beryllium content copper alloy was completely non-linear. This shows that Readhead's readsorption model (refer to P. A. Redhead, J. Vac. Sci. Technol. A14, 2599(1996)) is correct. The P(t) curve gradually approaches $P(t)=k_1\cdot t^{1/2}$ to be a straight line in about 1 week after accumulation. The outgassing amount becomes smaller over time lapse. The fact that the outgassing rate is proportional to $t^{-1/2}$ shows that the surface of sample is completely terminated with hydrogen atoms and the outgassing from copper alloy is completely limited by diffusion from the inside of bulk. From the data of FIGS. 1 to 4, although the BeO film is considerably dense, it is difficult to conclude that the film is not permeated by hydrogen at all. Therefore, from the fact that P(t) is proportional to $t^{1/2}$, it is suggested that the concentration gradient of hydrogen occurred in bulk 24. Specifically, as shown in the model of FIG. 9A, it is suggested that the concentration gradient of hydrogen occurred in the bulk 24 and the outgassing occurred based on diffusion-limited model. Note that reference numeral 24 denotes the same disk explained in FIG. 7 and 32 denotes the BeO film.

Figure 9B:
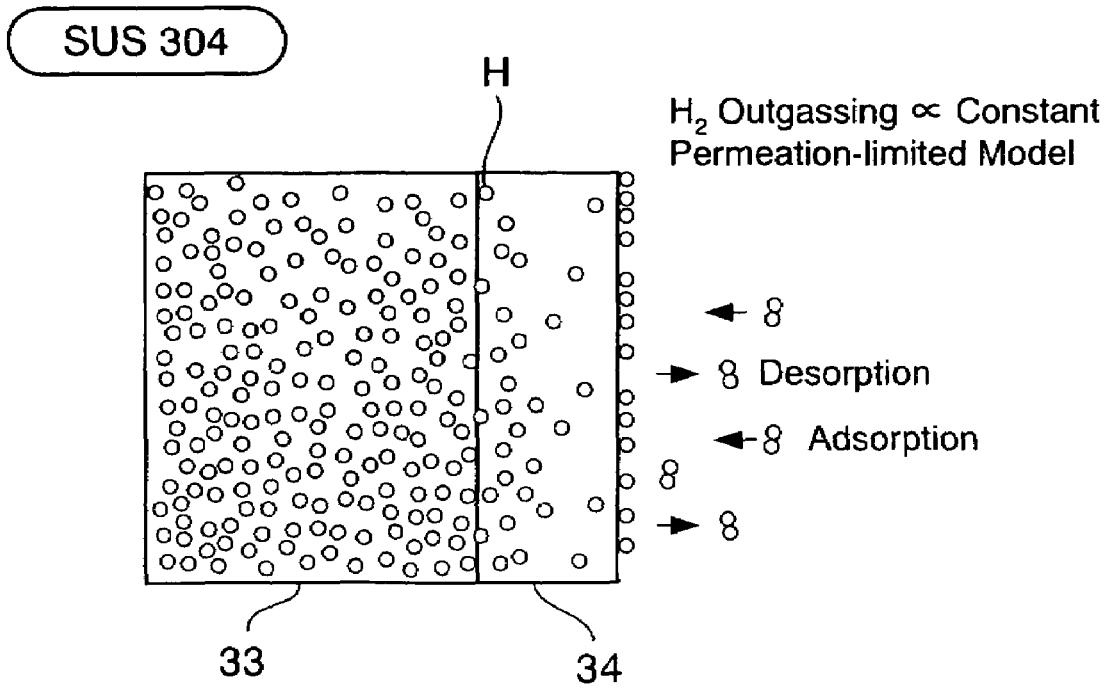
FIG. 9B is a schematic view showing the outgassing of hydrogen from the material for vacuum device, which is the comparative example.

On the contrary, stainless steel 304 shown in FIG. 8B has $P(t)=k_2\cdot t$, which is the same as the published data by the gas accumulation method that has been reported. In the outgassing theory, a large amount of hydrogen is in the stainless steel bulk and the hydrogen outgassing from stainless steel is described as recombination-limited model where hydrogen atoms permeating through the $Cr_2O_3$ film recombine into hydrogen molecules to generate outgassing. It is presumed from the result of the present examination that, as shown in FIG. 9B, outgassing of hydrogen in the stainless steel bulk 33 is prevented by the $Cr_2O_3$ film 34 and the outgassing rate is limited by permeation in a room temperature state under ultra-high vacuum. Since the hydrogen concentration in the stainless steel bulk 33 is higher than that of the copper alloy by orders of magnitude, the hydrogen concentration in the $Cr_2O_3$ film 34 changes little even if time passes. Thus, the outgassing rate becomes at a constant level. Accordingly, it is described that outgassing from stainless steel bulk is regulated by the permeation-limited model not the conventional recombination-limited model. A ground to support it is based on that a non-linear state appears even in stainless steel in the accumulation within 1 hour, as Redhead predicted. In short, the non-linear state appears in stainless steel as well until a certain period of time passes to cover a surface adsorption site with hydrogen by 100%. Regarding all the outgassing rate of stainless steel that has been reported in published data, measurement thereof could start only from the time when P(t) became a complete straight line after closing the gas communication path. This is because of the large value of V/A. This is believed to have prevented the observation of the non-linear state of Redhead.

Figure 10:
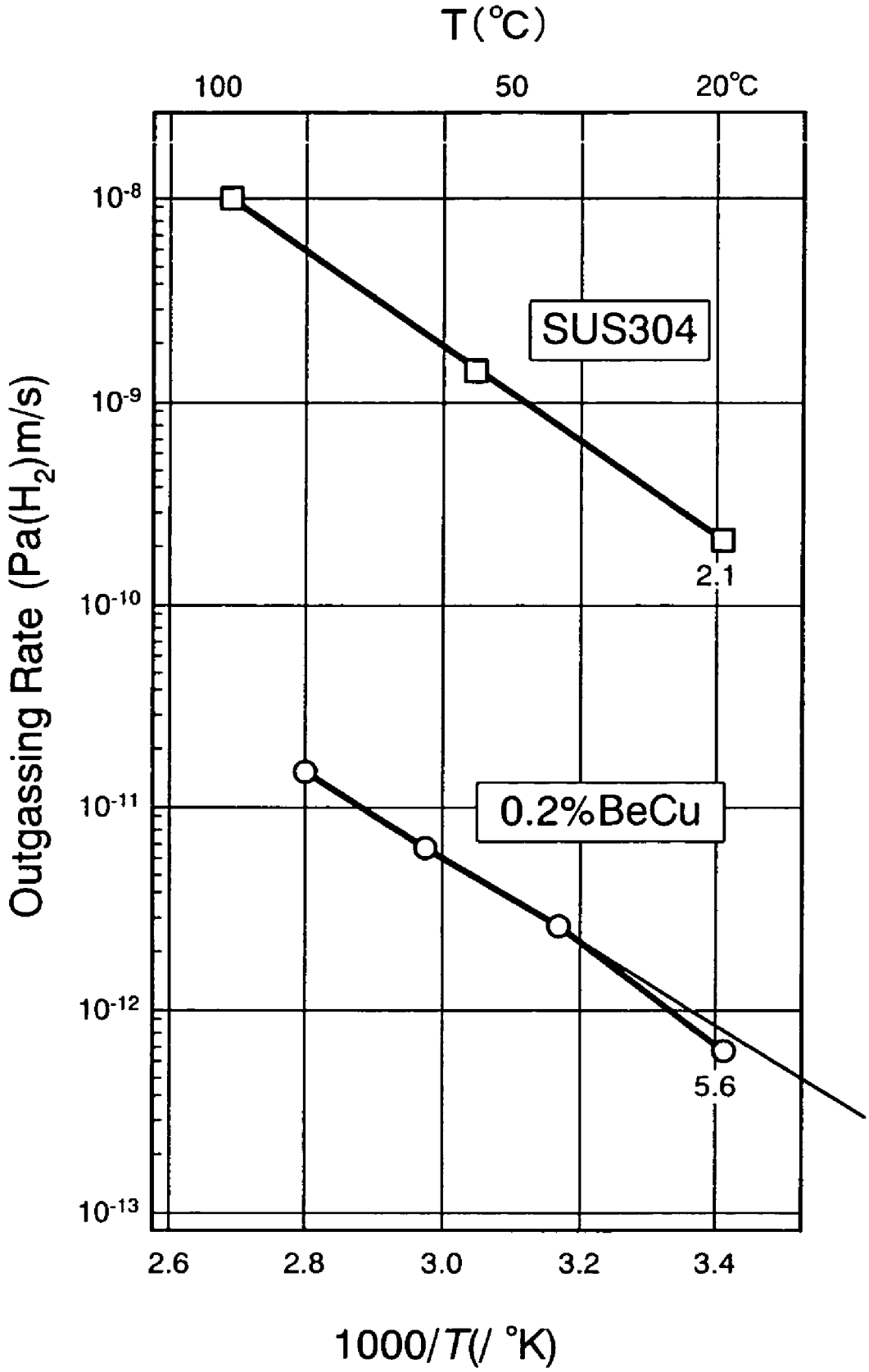
FIG. 10 is a graph showing the relationship between the minimum value of the outgassing rate and thermal treatment temperature regarding the materials for vacuum device, which are the first embodiment of the present invention and the comparative example.

FIG. 10 is the graph showing the relationship between the minimum value of the outgassing rate and the thermal treatment temperature, which is Arrhenius plots. In FIG. 10, the axis of ordinate and the axis of abscissa show the outgassing rate ($Pa(H_2)\cdot m/s$) expressed in logarithmic scale and 1000/T (/° K) expressed in linear scale, respectively.

In FIG. 10, in the case of 0.2% beryllium content copper alloy, the outgassing rates were plotted corresponding to an area that completely overlaps $t^{1/2}$ after 3 to 4 weeks passed in the graph of FIG. 8A. Further, in the case of stainless steel 304, those were plotted corresponding to values found in the straight line area after 4 days passed.

According to FIG. 10, the plots completely overlap the straight line in the case of stainless steel 304, and on the other hand, in 0.2% beryllium content copper alloy, those do not overlap a straight line but show a gentle curve. The reason in the latter case is presumed that the amount of hydrogen in the sample bulk is decreased quickly as the measurement is repeated, that is, as time passes. In other words, this shows that the longer the time where the material is left to stand in vacuum, the smaller the outgassing of the copper material can be to any amount. Particularly in the case of 0.2% beryllium content copper alloy, the outgassing rate even in the temperature-rise state of 100° C. is far smaller than the outgassing rate of stainless steel in a room temperature state. The outgassing rate of 0.2% beryllium content copper alloy at the end of measurement is reduced to $5.6\times10^{-13}$ $Pa(H_2)\cdot m/s$. Further, when comparing at a same temperature, the outgassing rate of 0.2% beryllium content copper alloy is 1/375 lower than that of stainless steel. Moreover, taking in consideration that SRG 31 and the sealing valves 26 used for measurement still have areas of stainless steel (0.7%) and the gaskets is not subject to pre-bakeout, the outgassing rate of 0.2% beryllium content copper alloy is presumed to have reached an ultimately small outgassing rate of the order of $10^{-14}$ $Pa(H_2)\cdot m/s$.

Note that treatment using oxygen was performed to the copper alloy to form the barrier film composed of the oxide film of doping element on the surface of the copper alloy in the above-described experiment, but using single nitrogen, mixed gas of oxygen and nitrogen or ozone ($O_3$) instead of oxygen, the oxide film of doping element, nitride film thereof or oxide-nitride film thereof may be formed as the barrier film on the surface of the copper alloy. Further, oxygen content compound, nitrogen content compound, or oxygen-nitrogen content compound which is NO gas for example may be used instead of oxygen. Furthermore, a plasma of any one of the above processing agents may be used.

The material requires, as described regarding FIGS. 3A, and 3B, that a thickness of this barrier film is thicker, for example 5 nm or more, than that of a naturally formed film by exposing it to air after mechanical polishing or electro-polishing, and that the surface is covered with the barrier film in coverage of 90% or more.

Furthermore, although beryllium (Be) is used as the doping element to the copper alloy, single B, Mg, Al, Si, Ti or V may be used instead of Be, or the doping element composed of the combination of two or more of Be, B, Mg, Al, Si, Ti or V may be used.

(ii) Material for Vacuum Device and its Manufacturing Method

Based on the above-described examination results, the materials for vacuum device and its manufacturing method will be explained as follows.

The material for vacuum device is one where the oxide film, the nitride film or the oxide-nitride film of a doping element is coated on the surface of the base material made of the alloy of Cu and at least one of Be, B, Mg, Al, Si, Ti and V which are the doping elements.

Figure 11:
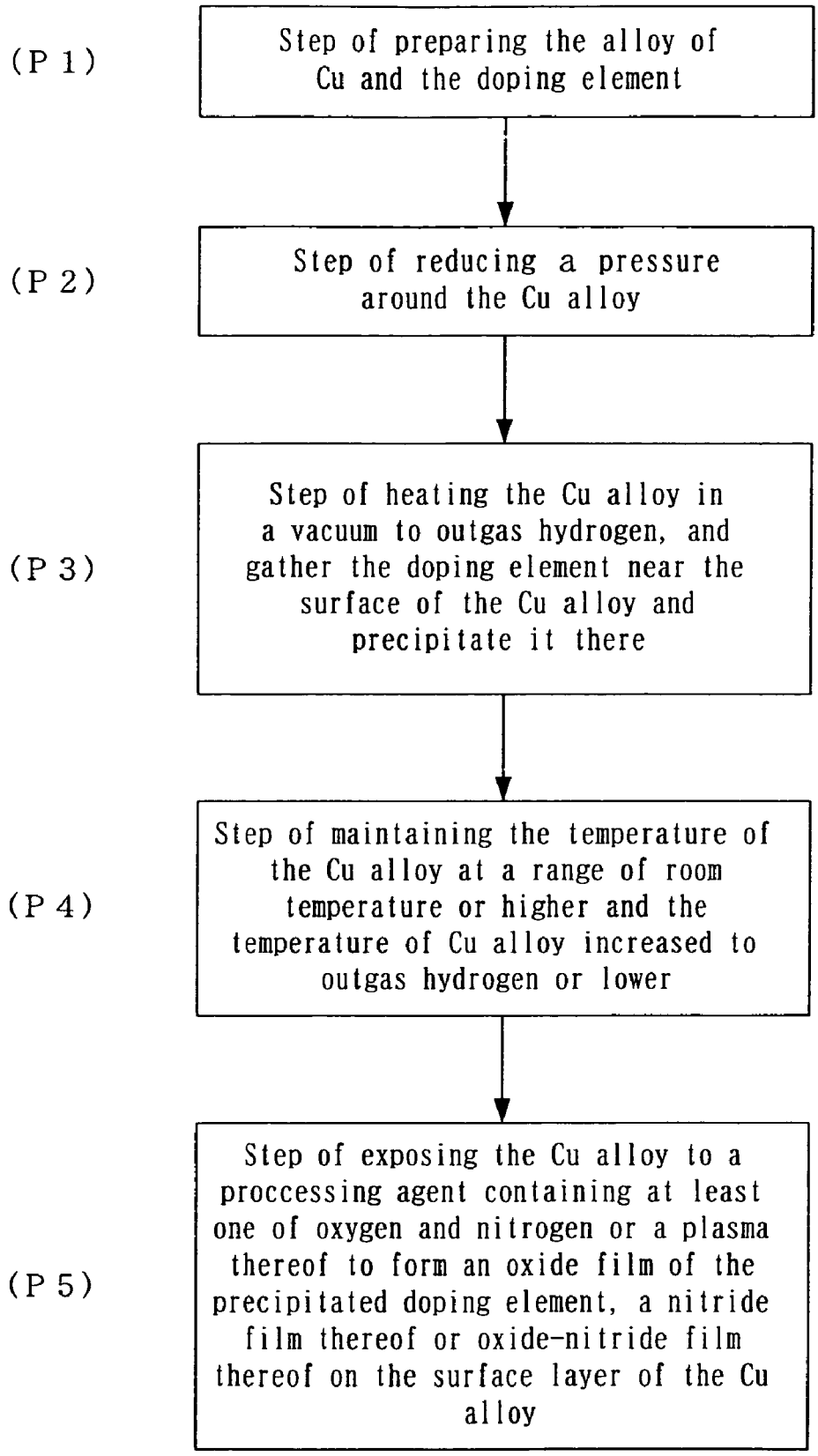
FIG. 11 is a flowchart showing the manufacturing method of the vacuum device, which are the first embodiment of the present invention.

Next, the manufacturing method of the above-described materials for vacuum device will be explained referring to FIG. 11. FIG. 11 is the flowchart showing the manufacturing method.

Firstly, the alloy of Cu and the doping element (hereinafter, referred to as Cu alloy) is prepared (P1). As the alloy of Cu and the doping element, the Cu alloy containing doping element by single Be, B, Mg, Al, Si, Ti or V, or the combination of two or more of the doping elements can be used. Herein, the Cu alloy made of 0.2% Be, 2% Ni and bal. Cu is used.

The pressure around the alloy of Cu and the doping element is reduced to the level of vacuum at approximately $10^{-6}$ Pa (P2).

Subsequently, the Cu alloy is heated in the vacuum and the temperature is increased to approximately 400° C. (P3). The temperature is maintained for about 24 hours to 72 hours. Since the Cu alloy softens at the temperature of 400° C. or higher, the hardness of a knife-edge portion becomes insufficient when the material is applied for the vacuum device such as a flange. Further, even in the case where the content of Be is as low as 0.2%, surface accumulation of Be is possible while hydrogen is positively outgassed if the temperature is 400° C., according to D data in FIG. 1A and FIG. 6A.

At this point, hydrogen diffuses outward in the Cu alloy first to reach near the surface of the Cu alloy. When the copper oxide film is formed on the surface of the Cu alloy, hydrogen out-diffused from the Cu alloy bulk reduces and decomposes (deoxidizes) the copper oxide film. This allows hydrogen to be outgassed from the Cu alloy without encountering an obstacle. On the other hand, the doping elements gather near the surface of the Cu alloy and precipitate.

Next, the temperature of the Cu alloy is lowered to about 40° C. (P4), and then the Cu alloy is exposed to the processing agent such as single oxygen, single nitrogen, mixed gas of oxygen and nitrogen, ozone ($O_3$), oxygen content compound, nitrogen content compound and oxygen-nitrogen content compound, or the processing agent composed of a combination of them, or a plasma thereof (P5). Of the plasma thereof, for example, a plasma of nitrogen gas is generated by introducing pure nitrogen of 100 Pa into a chamber and causing a glow discharge in the chamber. With this, a reaction between inert nitrogen and the doping metal can be caused at a lower temperature. Note that the temperature of the Cu alloy when this treatment is performed is not limited to 40° C. Upper-limit treatment temperature is determined depending on the type of doping element in the Cu alloy or the type of treatment gas such as oxygen. When oxygen is used for the BeCu alloy as in this example, a dense and thin BeO oxide film can be formed if the treatment temperature is 100° C. or lower, as shown in FIG. 1A, FIG. 3A or the like. If the temperature exceeds 100° C., there is a possibility that oxygen passes the BeO oxide film to reach bulk copper and an unstable oxide film is formed.

Consequently, the doping element which is gathered near the surface of the Cu alloy and precipitated reacts with the processing agent such as single oxygen, single nitrogen, mixed gas of oxygen and nitrogen, ozone ($O_3$), oxygen content compound, nitrogen content compound and oxygen-nitrogen content compound, or the processing agent composed of a combination of them, or the processing agent composed of a plasma thereof, and thus one of the oxide film, nitride film and oxide-nitride film of the doping element is formed on the surface layer of the Cu alloy. The oxide film or the like of the doping element, particularly at least one of Be, B, Mg, Al, Si, Ti and V, is dense and has a sufficient barrier function against hydrogen.

As described above, in the manufacturing method of the materials for vacuum device of the first embodiment of the present invention, when the alloy of Cu and the doping element is heated to increase its temperature in vacuum, hydrogen in the alloy is gathered to the surface. Thus, even when the copper oxide film is formed on the surface, the hydrogen reduces and decomposes the copper oxide film formed on the surface. As a result, hydrogen is outgassed from the alloy without encountering an obstacle.

On the other hand, the temperature-rise allows the doping element in the alloy to precipitate on the alloy surface by diffusion. Subsequently, the temperature of the alloy is lowered and then the alloy is exposed to oxygen or the like. Thus, the doping element precipitated on the surface of alloy is oxidized or the like to form the oxide film or the like of the doping element such as Be, B, Mg, Al, Si, Ti and V, specifically.

The oxide film or the like of the doping element is a superior barrier layer against hydrogen. It results in the creation of the material for vacuum device in which hydrogen in the alloy of the doping element and copper is effectively outgassed, and the superior barrier layer against hydrogen is formed on the surface layer. After the thermal treatment, it is possible to prevent hydrogen from re-solving into the alloy even when it is exposed to air.

Therefore, in the vacuum apparatus fabricated by machining the alloy, the outgassing rate of $10^{-13}$ Pa($H_2$)·m/s or less from the vacuum device is easily achieved by only the thermal treatment to remove moisture or the like attached to the surface of the barrier layer before vacuum treatment. Therefore, ultra-high vacuum can be easily obtained in the vacuum apparatus using the alloy. Particularly, when the alloy is exposed to gas containing no hydrogen such as NO or a plasma of nitrogen gas to form a nitride film (a part of it is believed to have become an oxide-nitride film), it is suggested that the nitride film has smaller adsorption of moisture than the oxide film. Thus, low-outgassing can be easily achieved without the in-situ bakeout.

Second Embodiment

The processing method of the vacuum device or the vacuum apparatus provided with the vacuum device according to the second embodiment of the present invention will be explained as follows.

As an object being subject to this processing method, a vacuum apparatus is used. The vacuum apparatus is provided with a chamber (vacuum chamber) that conducts treatment in the vacuum and an evacuation system that evacuates the inside of the chamber. And at least one of the vacuum devices used for the chamber, the evacuation system and so on is made of material exposed to the vacuum, and the material is the alloy of Cu and the doping element which is specifically at least one of Be, B, Mg, Al, Si, Ti and V.

As the vacuum device, there are vacuum wall materials, vacuum joints, vacuum piping, vacuum pumps, vacuum valves, observation windows, bolts, nuts, vacuum motors, vacuum gauges, mass analyzers, surface analyzers, electron microscopes, electric terminals, electrodes, lead wire for wiring in vacuum, substrate holders, metal vacuum tube, vacuum display, heat-reflecting board (reflector) in a vacuum processing furnace or the like. The vacuum apparatus is applicable for a plasma processing system that performs plasma CVD, plasma etching, sputtering deposition, sputtering etching, ion implantation, plasma surface treatment, or a vacuum processing system that performs thermal CVD, molecular beam epitaxy, atomic layer epitaxy (ALE), impurity diffusion, surface treatment, vacuum evaporation, or other various kinds of vacuum processing. Further, the system is applicable for a large-scale vacuum apparatus such as a particle accelerator, a storage ring and a space chamber.

In this processing method, at first the inside of the chamber is evacuated and decompressed via the evacuation system.

Subsequently, the temperature of the chamber is increased in the vacuum and hydrogen is removed from the vacuum device including the chamber. Even when the copper oxide film is formed on the surface of the vacuum devices, hydrogen gathered near the surface reduces and decomposes (deoxidizes) the copper oxide film formed on the surface. This allows hydrogen to be outgassed from the vacuum device without encountering an obstacle. Temperature-rise, at the same time, results in gathering the doping element, which constitutes the alloy material of the vacuum devices, near the surface of the vacuum devices and precipitating it.

Next, after lowering the temperature of the vacuum device, the vacuum devices are exposed to the processing agent such as single oxygen, single nitrogen, mixed gas of oxygen and nitrogen, ozone ($O_3$), oxygen content compound, nitrogen content compound and oxygen-nitrogen content compound, or the processing agent such as a combination of them, or the processing agent such as a plasma thereof. Thus, the doping element which is gathered near the surface of the vacuum devices and precipitated is allowed to react with the processing agent, and thus one of the oxide film, nitride film, or oxide-nitride film of the doping element is formed on the surface layer of the vacuum devices.

As described above, in the vacuum device or the vacuum apparatus according to the second embodiment, hydrogen in the vacuum device can be reduced and the barrier layer against hydrogen can be formed on the surface of the vacuum devices by performing the hydrogen outgassing and the forming processing of the barrier layer. Consequently, in the vacuum apparatus where the treatment of the present invention has been applied for the vacuum devices, the outgassing of hydrogen into the vacuum is prevented to reduce the outgassing rate from the vacuum device to $10^{-13}$ Pa($H_2$)·m/s or less. Thus, ultra-high vacuum can be easily obtained.

Third Embodiment

Next, description will be made for an experiment where applicability of the present invention for aluminum bronze alloy was confirmed.

In the aluminum bronze alloy, there is special aluminum bronze alloy whose strength is increased by doping a small amount of iron, manganese and nickel, in addition to binary alloy of aluminum and copper. Then, the special aluminum bronze alloy has the first type (JIS alloy number C6161), the second type (JIS alloy number C6191) and the third type (JIS alloy number C6241) as typical types, which are classified depending on the content of aluminum.

The first type is alloy having aluminum concentration of 7.0% to 10.0%. Presuming from the binary alloy statues view, the alloy always takes a stable crystal structure called α phase even if it is set under high temperature of 800° C. and even if it is slowly cooled down from the temperature. Its Rockwell hardness is stabilized at about B84 and it has superior characteristic regarding cold workability (workability at room temperature). The first type has high thermal conductivity and electric conductivity among the three types of special aluminum bronze alloy.

The second type is alloy having aluminum concentration of 8.5% to 11.0%. The hardness is as very high as B90 (approximately same as SUS304), and its strength increases as well. Further, hot workability is improved and the crystal structure takes a mixed crystal of α phase+β phase. However, when the alloy is in a temperature range of 565° C. and 370° C., β phase is unstable to generate $\gamma_2$ phase ($Cu_9Al_4$) in which the hardness increases but a phase that makes metal brittle grows. The $\gamma_2$ phase is a large disadvantage for high-strength alloy. To prevent this, when heat treatment is applied to it after machining the metal, it is often obedient to the way that the temperature is maintained at 600° C. or higher and the temperature is decreased in a manner such as allowing the metal to quickly pass the range of 565° C. and 370° C. by water cooling or the like.

The third type is alloy having aluminum concentration of 9.0% to 12.0%. It is the alloy whose strength is further increased from that of the second type. The $\gamma_2$ phase is easily generated more often to easily crack the alloy by an impact. To prevent this, it is important to quench the alloy by water cooling or the like.

Heretofore, the special aluminum bronze alloy has not been used as a material for vacuum device. However, taking the above-described characteristics in account, the special aluminum bronze alloy is applicable for materials for all vacuum devices if outgassing can be reduced by the present invention. Among others, the first type are suitable for electric terminals, bellows and chambers, and the second type are suitable for devices requiring hardness such as knife edge flanges.

Next, in order to confirm the effects by applying the present invention for the above-described special aluminum bronze alloy, description will be made for examination performed with regard to the surface change of copper alloy by vacuum thermal treatment and temperature desorption spectroscopy (TDS spectrum analysis).

(Surface Change of Copper Alloy by Vacuum Thermal Treatment)

(a) Fabrication of Examination Sample

As the alloy material of the examination sample, the second type of the special aluminum bronze alloy (Cu: 81% to 88%, Al: 8.5% to 11.0%, Fe: 3% to 5%, Ni: 0.5% to 2.0%, Mn: 0.5% to 2.0%) was used. Two pieces of the alloy material, which were machined into a cylindrical shape having the diameter of 5 mm and the height of 5 mm, were prepared. And they were set as the examination samples C and D.

The examination samples C and D were fabricated as follows. Sample C was only electropolished and stored in air. Sample D was electropolished, and then, was subject to thermal treatment for 24 hours under 500° C. in vacuum having the degree of vacuum at $10^{-6}$ Pa. Then, the temperature thereof is lowered to room temperature and then the sample is exposed to oxygen. After that, the sample is taken out to air.

(b) Examination Method and its Result

Element distribution in a surface atomic layer was examined for each sample C and D by an XPS (X-ray Photoelectron Spectroscopy) surface analyzer. Specifically, the distribution state of elements in the surface atomic layer before and after thermal treatment was obtained.

Figure 12A:
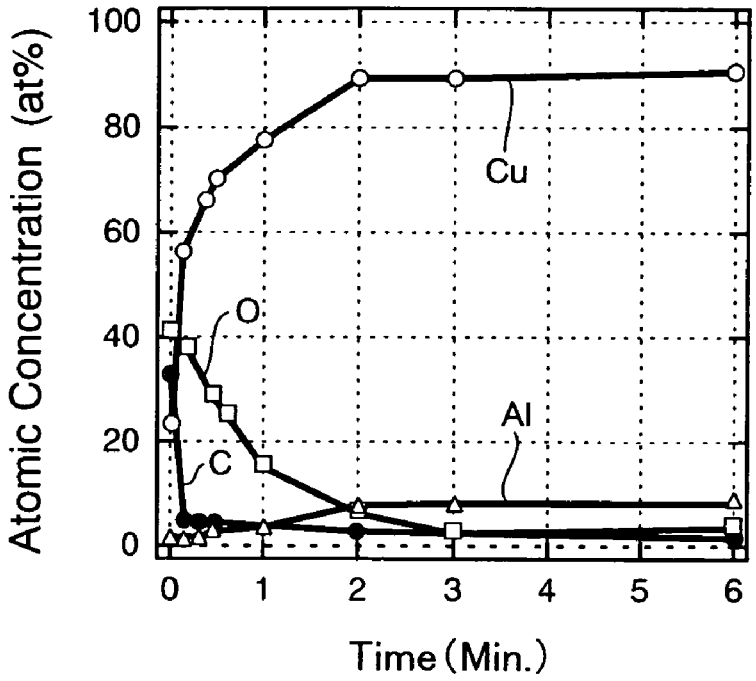
FIGS. 12A and 12B are graphs showing result where an in-plane distribution ratio of the atoms of the alloy material for vacuum device, which is the third embodiment of the present invention, was measured sequentially in a depth direction.
Figure 12B:
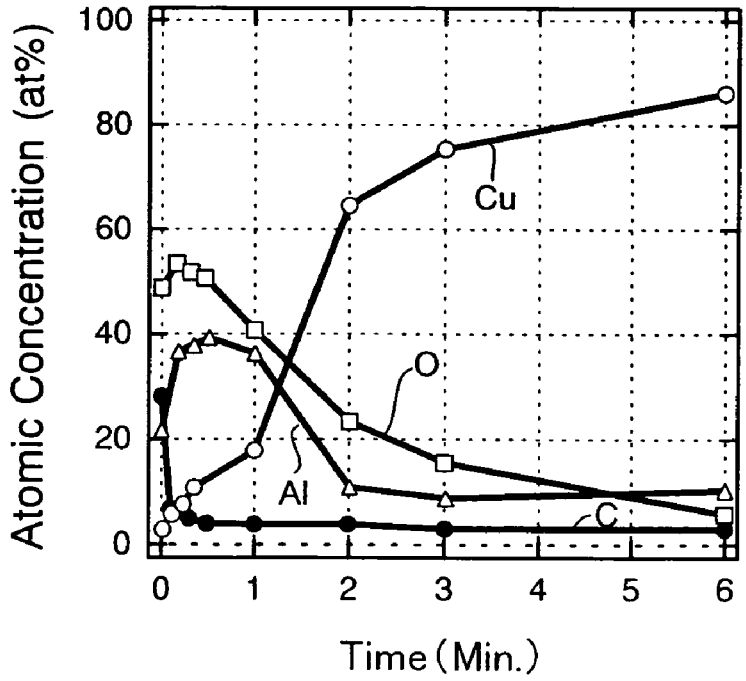

FIGS. 12A and 12B show the results. FIGS. 12A and 12B respectively show the result for samples C and D, where an in-plane distribution ratio of atoms was measured sequentially in a depth direction. A measurement surface in the depth direction was sequentially exposed by argon etching. In FIGS. 12A and 12B, the axis of ordinate shows the concentration (at %) of various atoms measured, which is expressed in linear scale, and the axis of abscissa shows time (minutes) of argon etching, which is expressed in linear scale. The argon etching rate is 4.5 nm/min.

In sample C, it turns out that an oxide layer on the sample surface prior to thermal treatment is thin and copper readily appears when the oxide layer is etched by several nm. As etching continued, the distribution ratio became substantially the same as the ratio of the aluminum bronze alloy.

On the other hand, substantially sample D is covered with an aluminum oxide layer by about 100%, and copper eventually appears when the aluminum oxide layer is etched by approximately 4 nm to 5 nm. Specifically, it was found out that aluminum, which is doping metal to aluminum bronze alloy, is diffused to the surface due to thermal treatment of 500° C. for 24 hours, and an oxide film of the doping metal can be formed by thickness of approximately 9 nm.

(Temperature Desorption Spectroscopy (TDS Spectrum Analysis))

(a) Fabrication of Examination Sample and Measurement Equipment

As examination samples, a chamber was fabricated by machining aluminum bronze alloy into a cup shape having the inner diameter of 38 mm and the inner length of 100 mm, and a cylindrical conversion flange was fabricated. By using the chamber and the conversion flange, sample E and sample F were prepared. Sample E was electropolished and was subject to no thermal treatment, and sample F was subject to vacuum outgassing thermal treatment at 720° C. for 10 hours, and then received $N_2$ gas at 720° C., followed by cooling down. And the conversion flange and the chamber were attached to the tip of the quadruple residual gas analyzer (RGA) as shown in FIG. 5 via a thermal shield conversion flange of stainless steel whose heat conduction is poor, and thus measurement equipment similar to the one in FIG. 5 was fabricated.

(b) Examination Method and its Result

The temperature desorption spectroscopy examination was performed by increasing temperature at the rate of about 0.3° C./sec by a sheath heater and checking outgassing characteristic with the temperature rise.

Figure 13A:
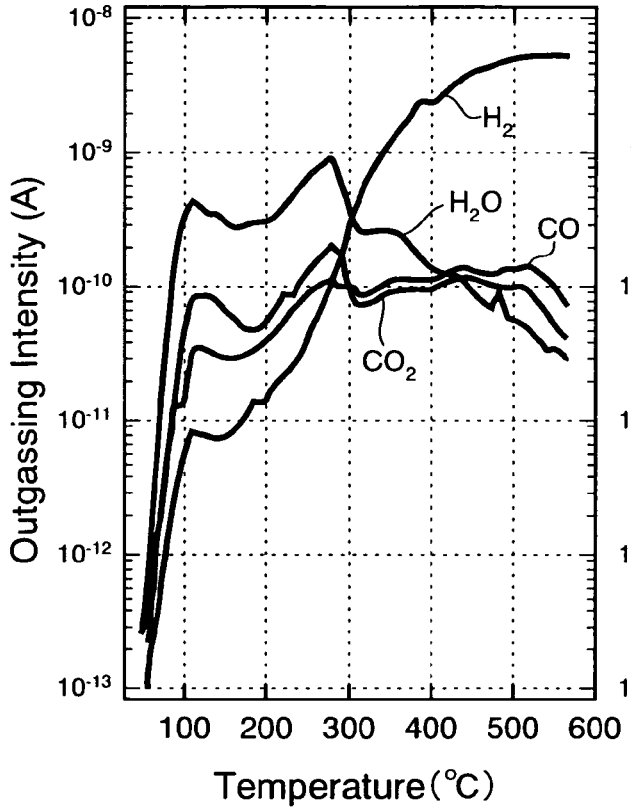
FIG. 13A is a graph showing an analyzing result of an examination sample (sample E) before thermal treatment with the temperature desorption spectroscopy according to the third embodiment of the present invention.
Figure 13B:
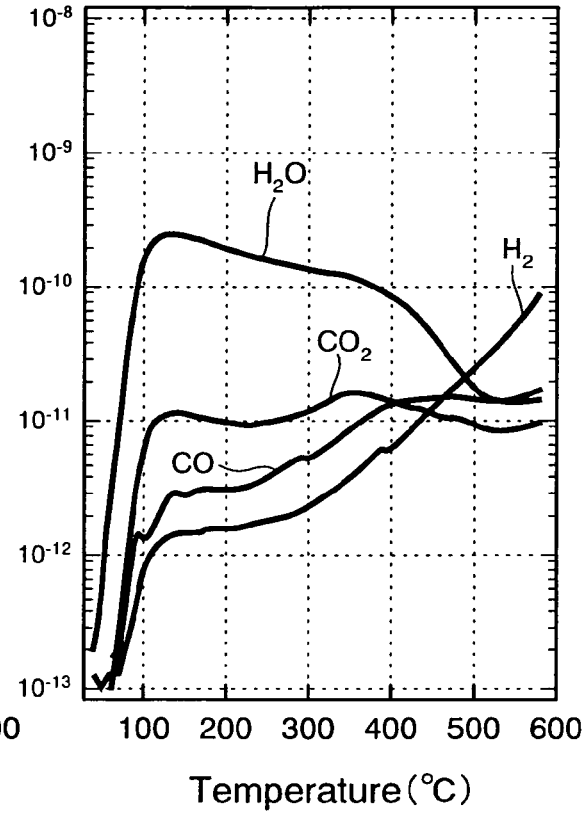
FIG. 13B is a graph showing an analyzing result of an examination sample after thermal treatment (sample F) with the temperature desorption spectroscopy according to the same.

FIGS. 13A and 13B show the examination results. FIG. 13A shows the examination result of the temperature desorption spectroscopy for the examination sample (sample E) before thermal treatment, and FIG. 13B shows the examination result of the temperature desorption spectroscopy for the examination sample (sample F) which was subject to thermal treatment at 720° C. for 10 hours in the vacuum. In each drawing, the axis of ordinate shows the outgassing intensity (A) expressed in logarithmic scale, and the axis of abscissa shows the measured temperature (° C.) expressed in linear scale.

Note that the aluminum bronze alloy, unlike the case of beryllium copper alloy, has behavior that the metal returns to original hardness even if the temperature is increased to as high as 800° C. and slowly cooled down (annealing). However, since measuring temperature is temperature-rise on an atmosphere side, it was set to a range of approximately 25° C. and 600° C.

(α) Sample E

A first and a second peaks appear at the two points of the measured temperature of about 94° C. and 290° C. in water spectrum of no thermal treatment, as shown in FIG. 13A. In this aspect, the case of the aluminum bronze alloy was the same as the case of FIG. 6A of the beryllium copper alloy. It is presumed that the second peak indicates the moisture which is generated associated with the decomposition (deoxidation) of copper oxide film due to the reducing reaction by hydrogen molecules diffused from the inside of copper. The occurrence of sudden increase of hydrogen in an area after the second peak is considered to indicate this reaction and, in addition, the increase of hydrogen diffused from the inside same as the case of the beryllium copper alloy.

As it is clear from FIG. 13A, it turns out that outgassing of hydrogen reaches a maximum at approximately 550° C. and begins to go down at higher temperature. Specifically, in the aluminum bronze alloy, it is possible to outgas it from the surface in a short time through diffusion of hydrogen inside the alloy bulk when thermal treatment is conducted at 600° C. or higher in vacuum, preferably around 700° C. to 800° C. In other words, in the aluminum bronze alloy, it is presumed that time required for outgassing treatment can be remarkably reduced comparing to the beryllium copper alloy.

(β) Sample F

Based on the result, sample F was placed in another vacuum furnace before fabricating the measurement equipment, and was subject to hydrogen outgassing treatment at 720° C. for 10 hours, followed by introducing nitrogen at high temperature as 720° C., and after that, lowering the temperature to 100° C., and then taking it out in air (sample F). This made the surface gloss of the aluminum bronze alloy nice honey gold color, from which it is presumed that a surface layer formed of a mixed crystal of aluminum oxide (alumina) and aluminum nitride grew on the surface. Then, sample F was attached to the ionizer flange of the residual gas analyzer and was subject to the temperature desorption spectroscopy examination.

As a result, a moisture peak (third peak) was unified at about 130° C. and its intensity also became small, as shown in FIG. 13B. Specifically, detected moisture is presumed to be only one generated from the surface. This indicates that temperature rise did not cause structural change of the mixed crystal on the surface layer due to the reducing reaction of the surface layer. Further, from this result, it turns out that baking temperature of 200° C. at the maximum is sufficient in baking to remove water, in a chamber system using the vacuum structure material of the aluminum bronze alloy.

The outgassing intensity of hydrogen in TDS spectrum at 450° C. after thermal treatment is drastically smaller than that of sample E before thermal treatment. Specifically, it became as small as 1/500. On the other hand, it is reduced only to approximately 1/10 in the case of the beryllium copper alloy (comparison between FIG. 6A and FIG. 6B). Regarding the aluminum bronze alloy, the reason why the outgassing amount was smaller by order of magnitude like this comparing to the beryllium copper alloy is considered that hydrogen outgassing treatment and diffusion of doping metal, which is aluminum, could be performed at high temperature exceeding 700° C. and effectively.

Furthermore, regarding the aluminum bronze alloy, since its temperature is elevated to 720° C., it is possible to react nitrogen gas, which is inert generally, with the active aluminum exceeding the melting point (660° C.), and thus the mixed crystal of aluminum oxide and aluminum nitride can be formed.

Moreover, regarding the two types of knife edge flanges fabricated by the aluminum bronze alloy whose surface was oxidized and nitrided, pure copper gaskets were sandwiched by the flanges and baking was performed for about 4 hours by maintaining the temperature of the flanges at 300° C. After the baking, the temperature was lowered to room temperature, and then bolts were unfastened. Both flanges could be removed from the pure copper gaskets without a problem. In other words, cold junction did not occur even when the flanges of aluminum bronze alloy directly sandwiched the pure copper gaskets. It is presumed that it is because a dense mixed crystal film was formed on the surface of the aluminum bronze alloy. On the other hand, flanges, which were made of beryllium copper alloy to which no plating was applied, adhered to the pure copper gaskets at 150° C. And even flanges of NiP plated beryllium copper alloy adhered to the gaskets at 300° C. or higher and a part of plating peeled off.

As described above, by high temperature treatment at 600° C. or higher in vacuum to the aluminum bronze alloy, hydrogen molten inside the metal bulk can be positively outgassed, and aluminum that is the doping metal is diffused to the surface to form an alumina film, nitride film or oxide-nitride film which protects the surface. Further, it is presumed that the mixed crystal has a thickness of 9 nm or more, and covers the surface by approximately 100%. The mixed crystal is 5 to 20 times thicker than a natural oxide film formed by a mechanical polishing or an electro polishing, and thus it turns out that it serves as a barrier film to permeation of hydrogen atoms. In other words, as a conclusion, it is important, regarding the aluminum bronze alloy as well, that the film thickness is about 5 nm or more for aluminum oxide, aluminum nitride or aluminum oxide-nitride of mixed crystal, which is formed on the surface thereof and is a compound of the doping metal.

Thus, removal of hydrogen from vacuum materials and prevention of hydrogen re-solution into the vacuum materials are achieved substantially completely, and vacuum materials that are inexpensive and easily machined can be provided.

Next, features in the case where the beryllium copper alloy and the aluminum bronze alloy are used as the vacuum material will be compared based on the above-described results.

(i) Beryllium Copper Alloy (a) Outgassing can be reduced while the reduction of electric conductivity is restricted.

(b) Treatment at the thermal treatment temperature of 400° C. or less is desirable in order to prevent the hardness reduction.

(c) Plating treatment by nickel-phosphorous to areas contacting air is desirable in order to prevent oxidation during baking. Further, when the beryllium copper alloy is used as the flange, it is desirable to use silver-plated copper gaskets.

(ii) Aluminum Bronze Alloy (a) The thermal treatment temperature can be set to as high as 600° C. or higher. There is no possibility of hardness reduction, but on the contrary, the hardness increases.

(b) Plating treatment is not necessary. Further, when the aluminum bronze alloy is used as the flange, the copper gaskets can be directly used without plating the aluminum bronze alloy.

(c) The material is inexpensive.

(d) The surface is honey gold color and looks nice.

(e) The surface oxide film does not have toxicity at all.

(f) Although the thermal conductivity and electric conductivity are smaller than those of pure copper and beryllium copper alloy, they are larger than those of stainless steel.

As described above, in the vacuum components fabricated by the present invention regarding either beryllium copper alloy or aluminum bronze alloy, outgassing of hydrogen can be reduced very much, and re-solution of hydrogen from outside can be prevented. However, in a vacuum system constituted by the above-described vacuum devices, further baking is required to remove moisture adsorbed on the surface.

Therefore, a thin film of single carbon having a function to suppress the adsorption of water (moisture), which is amorphous carbon coating, diamondlike carbon (DLC), a diamond thin film or the like, specifically, is coated on the surface of the vacuum devices, and thus ultrahigh vacuum can be obtained even without baking. Note that the film of carbon such as amorphous carbon, DLC or the like is formed by plasmanizing a gas containing carbon, for example, ethane or methane, in which a pressure is adjusted to about 0.1 Pa to 10 Pa for example, so as to fit for discharging. Further, a carbon monoxide may be used.

As described above, the present invention has been explained in detail according to the embodiments, but the scope of the invention is not limited to the examples specifically shown in the above-described embodiments, and modifications of the above-described embodiments without departing from the gist of the invention is included in the range of the present invention.

For example, in the above-described embodiments, single beryllium (Be) is used as the doping element in the alloy of the doping element and copper, but at least one of boron (B), magnesium (Mg), aluminum (Al), silicon (Si), titanium (Ti) and vanadium (V) can be used instead of Be.

Further, the method of forming the oxide film or the like of the doping element on the surface of the copper alloy may be conducted in a manner such that intended gas is initially filled in the system at 1 Pa to a few Pa, and then another gas (such as dry nitrogen) is filled, and afterwards the alloy is brought out into air. This pressure is enough for forming an intended film.

Furthermore, the doping element precipitated on the surface of the copper alloy may be exposed to a plasma of the intended gas, for example single nitrogen.

As described above, the material for vacuum device of this invention is one where the oxide film, nitride film or oxide-nitride film of the doping element is coated on the surface of the base material made of the alloy of Cu and at least one of Be, B, Mg, Al, Si, Ti and V which are the doping elements.

The material for vacuum device can be fabricated in a manner such that the temperature of the alloy of Cu and the doping element is increased to outgas hydrogen from the alloy and precipitate the doping element in the alloy on the surface of the alloy, and then while the temperature of the alloy is maintained at a range of room temperature or higher and the temperature of the alloy increased for removing hydrogen or lower, the alloy is exposed to a processing agent containing oxygen or nitrogen, or a plasma thereof to form the oxide film, the nitride film, or the like of the doping element.

In the present invention, the alloy of Cu and the doping element is heated in the vacuum to increase its temperature to diffuse outward hydrogen inside the alloy bulk and outgas it from the surface. At this point, even when the copper oxide film is formed on the surface, the hydrogen reduces and decomposes the copper oxide film. As a result, hydrogen is outgassed from the alloy bulk without encountering an obstacle. On the other hand, the doping element is out-diffused from the inside of the alloy bulk to be gathered to the alloy surface and be precipitated there. Subsequently while the temperature of the alloy is maintained at a range of room temperature or higher and the temperature of the alloy increased for removing hydrogen or lower, the alloy is exposed to oxygen, nitrogen or the like, and thus the doping element precipitated on the alloy surface or the like is oxidized or nitrided or the like to form the oxide film, nitride film or the like of the doping element. The oxide film or the like of the doping element, particularly at least one of Be, B, Mg, Al, Si, Ti and V, has the superior barrier function against hydrogen.

As described above, the material for vacuum device of the present invention can be reduced in the content of hydrogen inside the material itself and can have resistance to the hydrogen outgassing from the inside of the material and hydrogen re-solution from air or the like into the material. Therefore, when necessary, only an in-situ bakeout at several hundreds of degrees in centigrade is performed to remove moisture or the like attached to the barrier layer surface before vacuum treatment, and thus the outgassing rate of $10^{-12}$ Pa($H_2$)·m/s or less from the vacuum devices can be easily achieved.

Further, the above-described material for vacuum device may be machined to fabricate the vacuum device, or the vacuum apparatus may be fabricated using the vacuum device. Alternatively, before performing the processing of hydrogen outgassing and barrier layer formation of the present invention to the alloy of Cu and the doping element, the alloy is machined to fabricate the vacuum devices, or further the vacuum devices are assembled to fabricate the vacuum apparatus, and then, the processing of hydrogen outgassing and barrier layer formation of the present invention may be performed to the vacuum device and the vacuum device of the vacuum apparatus. Consequently, also hydrogen content inside the vacuum device can be reduced and the barrier layer against hydrogen can be formed on the surface of the vacuum devices.

Accordingly, in the vacuum apparatus where the treatment of the present invention has been applied for the vacuum devices, hydrogen outgassing into the vacuum can be prevented to reduce the outgassing rate from the vacuum devices, and thus the ultra-high vacuum can be easily obtained.

What is claimed is:

1. A material for a vacuum device, comprising:

a base material made of an alloy of Cu and at least one doping element selected from the group consisting of Be, B, Mg, Al, Si, Ti and V;

a first film of an oxide, a nitride or an oxide-nitride of the doping element coating a surface of the base material; and a second film of carbon formed on said first film.

2. A vacuum chamber having an interior blocked from outside air and fabricated from a base material of an alloy of Cu and at least one doping element selected from the group consisting of Be, B, Mg, Al, Si, Ti and V, said vacuum chamber coated with a first film of an oxide, a nitride or oxide-nitride of said doping element, said first film preventing outgassing of hydrogen from the base material into the interior of the vacuum chamber and with a second film of carbon formed on said first film.

3. A vacuum apparatus comprising said vacuum chamber of claim 2.

4. A vacuum apparatus according to claim 3 wherein the vacuum chamber comprises a cylindrical body portion and a lid closing one end of the cylindrical body portion.

5. A vacuum chamber according to claim 2 comprising a cylindrical body portion and a lid closing one end of the cylindrical body portion.

6. A vacuum chamber according to claim 5 further comprising an ionizer.

7. A vacuum chamber according to claim 5 further comprising a heater surrounding the cylindrical body portion.

* * * * *